US007449844B2

(12) United States Patent
Lev et al.

(10) Patent No.: US 7,449,844 B2
(45) Date of Patent: Nov. 11, 2008

(54) DIGITAL POWER CONTROLLER FOR GAS DISCHARGE DEVICES AND THE LIKE

(75) Inventors: Arie Lev, Rehovot (IL); Rafael Mogilner, Rehovot (IL); Daniel Rubin, Nes Ziona (IL); Yoel Sharaby, Mevasseret Zion (IL); Moshe Kalichstein, Tel Aviv (IL)

(73) Assignee: Systel Development + Industries Ltd., Ness Ziona (IL)

( * ) Notice: Subject to any disclaimer, the term of this patent is extended or adjusted under 35 U.S.C. 154(b) by 0 days.

(21) Appl. No.: 10/939,722

(22) Filed: Sep. 13, 2004

(65) Prior Publication Data

US 2005/0035729 A1 Feb. 17, 2005

Related U.S. Application Data

(62) Division of application No. 09/857,616, filed as application No. PCT/IB99/02087 on Dec. 7, 1999, now Pat. No. 6,963,178.

(60) Provisional application No. 60/111,322, filed on Dec. 7, 1998, provisional application No. 60/111,302, filed on Dec. 7, 1998, provisional application No. 60/111,296, filed on Dec. 7, 1998, provisional application No. 60/111,235, filed on Dec. 7, 1998, provisional application No. 60/111,216, filed on Dec. 7, 1998.

(51) Int. Cl.
*H05B 37/02* (2006.01)
*G05F 1/00* (2006.01)

(52) U.S. Cl. ..... 315/291; 315/307

(58) Field of Classification Search ..... 315/224, 315/244, 291, 307, 289, 206, DIG. 5, DIG. 7; 363/34, 37, 98

See application file for complete search history.

(56) References Cited

U.S. PATENT DOCUMENTS 5,063,490 A * 11/1991 Maehara et al. ..... 363/37

(Continued)

FOREIGN PATENT DOCUMENTS

DE 19639873 6/1997

(Continued)

OTHER PUBLICATIONS

Patent Abstracts of Japan vol. 1999, No. 02, Feb. 26, 1999.

(Continued)

*Primary Examiner*—Shih-Chao Chen
*Assistant Examiner*—Minh Dieu A
(74) *Attorney, Agent, or Firm*—Mark M. Friedman

(57) ABSTRACT

A programmable digital power controller for gas discharge devices such as fluorescent lamps or other devices using all digital internal and external programmable controls. A specific ASIC is described. A gate array and microcomputer share parallel functions with fast sub-functions carried out by the gate array and slower sub-functions carried out by a micro-processor. Circuits are provided for automatic shut down when a high frequency ground fault is detected; for connecting the filaments of multiple gas discharge devices in a series/parallel circuit in a manner that power for a particular device is disabled when that device is removed from the circuit; for driving the load as close to resonance as possible but in an inductive mode; and for developing a dead time between high side and low side switches which is related to transformer current, switch current, bridge voltage or bridge voltage dv/dt.

11 Claims, 17 Drawing Sheets

(CURRENT SENSE PROTECTION)

U.S. PATENT DOCUMENTS

| | | | | | |
|---|---|---|---|---|---|
| 5,287,008 | A | | 2/1994 | Pahr | 307/91 |
| 5,406,471 | A | * | 4/1995 | Yamanaka | 363/124 |
| 5,469,028 | A | | 11/1995 | Nilssen | 315/291 |
| 5,500,792 | A | | 3/1996 | Song et al. | 363/98 |
| 5,569,984 | A | | 10/1996 | Holtslag | 315/307 |
| 5,598,326 | A | * | 1/1997 | Liu et al. | 363/34 |
| 5,691,605 | A | | 11/1997 | Xia et al. | 315/307 |
| 5,757,141 | A | | 5/1998 | Wood | 315/224 |
| 5,877,926 | A | | 3/1999 | Moisin | 361/42 |
| 6,002,213 | A | | 12/1999 | Wood | 315/307 |
| 6,104,147 | A | * | 8/2000 | Nakamura et al. | 315/289 |
| 6,707,261 | B2 | * | 3/2004 | Ito et al. | 315/224 |

FOREIGN PATENT DOCUMENTS

| | | |
|---|---|---|
| EP | 0469255 | 2/1992 |
| GB | 2298749 | 9/1996 |
| WO | 9009087 | 8/1990 |

OTHER PUBLICATIONS

JP 10 303674 A (Sony Corp), Nov. 13, 1998 abstract.

* cited by examiner (CURRENT SENSE PROTECTION)

(VOLTAGE SENSE PROTECTION)

(DV/DT SENSE PROTECTION)

(CONTINUOUS REACTIVE LOAD)

(PREDICTED MINIMUM DEAD TIME)

(INTERCONNECTION DIAGRAM FOR PLC CONTROL APPLICATION)

(BRIDGE CONTROL GRAPHICAL DESCRIPTION OF RANGE OF THE PULSE WIDTH FOR THE BRIDGE SWITCHES)

(ASIC DC/AC BLOCK DIAGRAM)

ASIC PIN ASSIGNMENT

| Die Pin Name | PLC D.E.B. | DC D.E.B. | LOCAL D.E.B. | OCC D.E.B. | E.B. | W.C.U. | Notes |
|---|---|---|---|---|---|---|---|
| Vcc Digital | + | + | + | + | + | + | |
| Gnd Digital | + | + | + | + | + | + | |
| X1-Crystal | + | + | + | + | + | + | |
| X2-Crystal | + | + | + | + | + | + | |
| Reset | + | + | + | + | + | + | |
| Vcc Analog | + | + | + | + | + | + | |
| Gnd Analog | + | + | + | + | + | + | |
| V Ref. | + | + | + | + | + | + | |
| I0 | 30Kohm | 0ohm | 51Kohm | 13Kohm | 130Kohm | x | Analog |
| I1 | Zone | DC control | Sensor,Occ | Occ. Dimmed level | x | Sensor,Occ | Analog |
| I2 | VDC (dc bus) | VDC (dc bus) | VDC (dc bus) | VDC (dc bus) | VDC (dc bus) | x | Analog |
| I3 | ILamp | ILamp | ILamp | ILamp | ILamp | x | Analog |
| I4,I5,I6,I7 | x | x | x | x | x | x | not used |
| Line Int. | + | + | + | + | + | + | |
| IR | x | x | + | x | x | + | |
| S0-S3 | + | + | + | + | + | Key0-Key3 | table |
| Sclk | Sclk | Sclk | Sclk | Sclk | Sclk | Sclk | table |
| Tx | Sda | Sda | Sda | Sda | Sda | Sda | table |
| Rcv | x | x | Occ. OFF | Occ. | x | com. rcvr | |
| Disp. Blank | x | x | x | x | x | + | |
| Disp. Data | x | x | x | x | x | + | |
| Disp. Clk | x | x | x | x | x | + | |
| Abnormal | + | + | + | + | + | x | |
| Zero Curr. | + | + | + | + | + | x | |
| Curr. Ref. | + | + | + | + | + | x | |
| Curr. Limit | + | + | + | + | + | x | |
| Center tap | + | + | + | + | + | x | |
| PLC Drv | x | x | x | x | x | + | |
| H.S.D. | + | + | + | + | + | x | |
| L.S.D. | + | + | + | + | + | x | |
| PLC Data | + | x | x | x | x | x | |
| PFC Drv | + | + | + | + | + | x | |
| AD0-AD7 | x | x | x | x | x | + | Ext ROM use |
| A8-A12 | x | x | x | x | x | + | Ext ROM use |
| ALE | x | x | x | x | x | + | Ext ROM use |
| WR | x | x | x | x | x | + | Ext ROM use |
| RD | x | x | x | x | x | + | Ext ROM use |
| Int/ExtROM | x | x | x | x | x | + | Ext ROM use |
| Psen | x | x | x | x | x | + | Ext ROM use |

FIG. 22

DIGITAL POWER CONTROLLER FOR GAS DISCHARGE DEVICES AND THE LIKE

This application is a division of 09/857,616 Jan. 2, 2002, U.S. Pat. No. 6,963,178 which is a 371 of PCT/IB 99/02087 Dec. 7, 1999 which claims benefit of 60/111,296 Dec. 7, 1998, and claims benefit of 60/111,235 Dec. 7, 1999 60/111,302 Dec. 7, 1998 60/111,332 Dec. 7, 1998 60/111,216 Dec. 7, 1998.

FIELD OF THE INVENTION

This invention relates to power controllers and more specifically relates to a power controller, using digital implementation with such stand-alone features as automatic shut down; dead time control, close to inductive side driving; and filament connections.

BACKGROUND OF THE INVENTION

Power controllers are well known and normally employ analog techniques. Digital techniques are normally avoided where smooth control is desired, for example, in controlling the dimming gas discharge lamps such as fluorescent lamps in an electronic ballast.

The present invention provides a novel digital implementation for power control circuits, particularly for the control of fluorescent lamp dimming.

Some limitations on analog power control systems are:

I. Inflexible Driving Algorithm

Optimal driving of power switches (MOSFETs, bipolar, transistors, thyristers, IGBTs and the like) requires complex algorithms based on non-linear multiple stage and variable functions, with a variety of predetermined parameters being chosen as the circuitry's physical parameters change.

For example, in the case of a fluorescent ballast power controller, flexible algorithms are desired to supply special loads when:

a) a complex working regime for fluorescent lamps including the preheat startup operation is needed.

b) Non-linear or special operation requirements for the fluorescent lamp complying to its V/I working curve, and as a function of the dimming decision table to provide the best operation at all light levels.

c) Flexibility to enable use of different lamp configurations (types and numbers of lamps) and different main voltages.

II. The number of electronic circuits increases as number of control function increases. If silicon implementation is feasible, it requires a large silicon overhead.

III. No Decision Tables

An analog solution does not provide "IF-THEN" decisions. It only provides "YES-NO" decisions using analog comparators and only linear predetermined algorithms. For example: voltage controlled oscillator (VCO) for frequency modulation (FM) or pulse width modulation (PWM) zero to max., pulse control, etc.

IV. No Parameters Set Tables

This has to do with different lamp configurations, in the case of a fluorescent lamp ballast, but also with many other decisions made by the controller in every state of its operation. One specific example is the time response of the lamp current loop being different at high level or low level as well as during transient or at steady state operation.

BRIEF DESCRIPTION OF THE PRESENT INVENTION

The present invention provides a number of novel improvements which can be integrated into a simple system, or, in some cases can be used singly in a stand-alone circuit. These improvements are:

I. Programmable predetermined fixed internal parameters can be programmed by the designer, by means of simple MMI, adapting control loops to the desired operation regimen and power circuit, while protecting the power circuit from damage if running it under "non-legal" settings. This technique allows on-the-spot matching of control to power circuit, instead the tedious and costly procedure common in digital signal processing (DSP) devices that requires programming of dedicated software and back and forth adapting of control to power.

The predetermined fixed internal parameters above refer to a set of numbers and tables intended for:

limits, constants, parameters and signed coefficients included in the control loop algorithm; and addressing/identification; etc.

Examples of the above are:

1. to normalize to "real" signals;
2. to create the limits for the "IF-THEN" algorithm.
3. to adapt to the designed configuration and the work regimen of the ballast.

II. Programmable predetermined parameter internal power configuration tables are provided.

III. An externally programmable new parameters table is provided that can be set for a specific application that cannot use the already existing tables (for example: an EEPROM function).

IV. Software substitutes may be used for analog circuits.

V. An application specific integrated circuit (ASIC) handles, in principle, an indefinite quantity of functions with an insignificant amount of silicon. Thus, all possible components/circuits/algorithms are integrated on the same silicon. This provides a simple low cost and enhanced solution with all the flexibility provided by software. The integration provides high noise immunization, eliminates intercircuit interfacing components, shares circuitry elements and allows dramatic space reduction.

VI. A gate array is provided which includes the fast algorithms or the fast portion of them, like:

1. Center Tap;
2. Zero, minimum and maximum current of the power factor corrector (PFC);
3. Generation of driver pulses.

VII. A microcomputer and the gate array share functions that are being carried out in parallel.

VIII. A very low-end microprocessor processes all the jobs by time-sharing instead of using the super-scalar processor used in DSPs.

IX. A gate array carries out all of its assignments in parallel. Functionally, the assignments operate in parallel and require separate gate array sections or blocks for each one.

X. The microprocessor manages the gate array operation, among others.

XI. The gate array receives input from monitoring nets and operates the immediate algorithm protections. In the case of fluorescent lamp dimming, the job is done by using all the main ASIC elements A/D, microprocessor, and gate array. In the embodiment described, the gate array also carries out watchdog functions.

XII. The microprocessor monitors protections being operated and takes care of long term actions.

XIII. In general, the functions constructed by fast and slow sub-functions are handled as follows:

The algorithm implemented in the gate array carries out the fast sub-functions which include fast pulses or actions. The sub-functions which require processing or actions that can be carried out during a slower mode, are carried out by the microprocessor. The novel structure and process of the invention provide a programmable integrated digital control module which can be used for a dimming fluorescent ballast. The control module features are:

a) Combines the Integrated Digital Control Dimmable Electronic Ballast (DEB) ASIC on a programmable printed circuit board product for new lighting ballast designs and evaluation suitable for low to medium volume production.

b) A large number of "on board" programmable, for example, 14, parameters define preheat, absolute light-level and dimming range.

c) An EEPROM enables the control parameters described above to use a single hardware platform for multiple lamps, diverse operation regimens and applications.

d) Integrated software defaults predefined parameters to a 2-lamp 32 w/36 w lamp drive for 120/230V a-c line/mains.

e) Incorporates all dimming ballast controls, including power conversion, into a single digital ASIC with multi-mode closed-loop control and pulse-by-pulse bridge protection.

f) A modified critical-mode boost PFC control achieves lowest total harmonic distortion (THD) at all light levels.

g) A series resonant lamp inverter control achieves less than 1% current-level control as required for architectural dimming fluorescent ballasts.

h) Module flexibility speeds product redesign and field testing in advance of custom ASIC software specification suitable for high-volume ballast products.

A large number of other features can be incorporated into the novel system of the invention, as integral parts of the system, or as stand alone features which could be incorporated into any ballast control circuit. These include:

1. A novel shut down circuit for turning off power to ballast in response to the sensing of a common mode high frequency current which exceeds a given value. In particular, an added winding is wound on the common mode choke to sense a high frequency around fault current and turn of power to the ballast in response thereto.

2. A novel circuit for connecting two or more filaments of two or more gas discharge lamps, particularly fluorescent lamps, in parallel so that removal of any lamp breaks that circuit while permitting the voltage applied to the lamp to be reduced for dimming. In particular, a series/parallel circuit is provided which enables energization of the lamp filaments with a half wave rectified DC.

3. A control arrangement for DC to AC inverters for driving non-linear loads such as electronic ballasts for high pressure and low pressure gas discharge lamps, resonant power supplies and laser power supplies and the like, wherein the control scheme employs both variable pulse width and frequency modulation, driving the load as close to resonance as possible but on the inductive side of resonance. Both the high side and low side switches of the bridge (half or full wave) are independently controlled in this arrangement.

4. A novel protection circuit for a bridge connected (half or full wave) inverter which supplies a resonant load such as a resonant electronic ballast for gas discharge lamps, which forces a dead-time during which no switch is driven in conduction without limiting the performance of the circuit. The point at which a dynamic dead-time begins is sensed by sensing the point where current collapses to zero in a capacitive timed circuit case. The sensing circuits may sense inductor current using a current transformer or shunt resistor, by sensing the current through the switching devices, by sensing the bridge voltage or by sensing the bridge voltage dv/dt.

According to the present invention, an electronic ballast for a gas discharge lamp is provided in which the electronic ballast has an input a-c circuit, a common mode inductor for connecting said input a-c circuit to a bridge connected rectifier, an inverter circuit including a high side switch and a low side switch which is coupled to the bridge connected rectifier, and a resonant circuit coupling the inverter circuit to and driving the gas discharge lamp. A monitor circuit is coupled to the common mode inductor for sensing a high frequency fault ground current, which has a frequency greater than the frequency of the input a-c circuit, to a ground connection. A controller circuit is coupled to the monitor circuit for turning off the inverter circuit or the power to the inverter circuit when the high frequency ground current exceeds a given value.

As another aspect of the present invention, an electronic ballast for at least two parallel connected gas discharge lamps removably mounted in a fixture is provided in which there is an inverter circuit, a resonant coupling circuit and at least two gas discharge lamps. The gas discharge lamps have first and second filaments. The resonant coupling circuit includes an inductor and a capacitor connected in series with the first and second filaments. First and second windings are coupled to the inductor and first and second diodes are connected in series with the first and second windings respectively and the first and second diodes respectively, whereby the disconnection of the lamps and the filaments from their fixtures opens the output circuit from the inverter circuit.

As another aspect of the present invention, an electronic ballast or a gas discharge lamp is provided in which there is an input a-c circuit. An a-c filter is connected to the input a-c circuit. A rectifier bridge is connected to the a-c circuit for producing an output d-c voltage from the a-c circuit input. An inverter circuit including a high side switch and a low side switch is connected in series at a node and connected across the output of the inverter circuit and a load circuit is connected to the node and includes the gas discharge lamp. The high side and low side switches each comprise MOSgated devices, and the like, having input control terminals energizable to turn them on and off and each has a parallel diode. A master control circuit applies suitably timed control signals for alternately turning the high side and low side switches on and off. A dynamic dead time control circuit in provided in the master control circuit for insuring only a short interval between the end of current conduction by either the high side and low side MOSgated devices, and the like, and the beginning of conduction by the other by the control of the application of controls signals to their control terminals. The dynamic dead time control circuit is coupled to and monitoring at least one of the current in the resonant load, the current in the first and second switches, the output voltage of the rectifier bridge or the rate of chance dv/dt of the bridge voltages, and adjusts the application of turn on signals to the high side and low side switches for both capacitive and inductive operations.

As still another aspect of the present invention, an electronic control module for controlling the operation of an electronic ballast for at least one lamp is provided in which the control module has an integrated circuit operable in accordance with control information to drive a first switch and a second switch to power the at least one lamp using a combination of pulse width modulation and frequency modulator. A first memory is coupled to the integrated circuit, the first memory storing a plurality of parameters tables, each parameters table having the control information for the integrated circuit.

As yet another aspect of the present invention, an integrated circuit for controlling the operation of an electronic lamp ballast is provided in which a central logic supervisor controls the overall operation of the electronic lamp ballast. A dc/ac generator module is coupled to the central logic supervisor and provides drive signals for an inverter circuit, the inverter circuit having a first switch and a second switch. A power line communication module is coupled to the central logic supervisor and receives dimming control data across a power line. A power factor correction module is coupled to the central logic supervisor and controls power factor detection and correction for the electronic lamp ballast.

As another aspect of the present invention, a method for controlling the dimming operation of an electronic ballast is provided in which a current through a load coupled to the electronic ballast is monitored and the current to maintain a dimming level is controlled.

BRIEF DESCRIPTION OF THE DRAWINGS

FIG. 22 shows the ASIC pin assignment for FIGS. 20 and 21.

DETAILED DESCRIPTION OF THE DRAWINGS

There is next described the various novel features which can be combined with one another and/or can stand alone. These are described in Sections I through V hereinafter.

I. The High Frequency Hazard Protection Circuit

Figure 1:
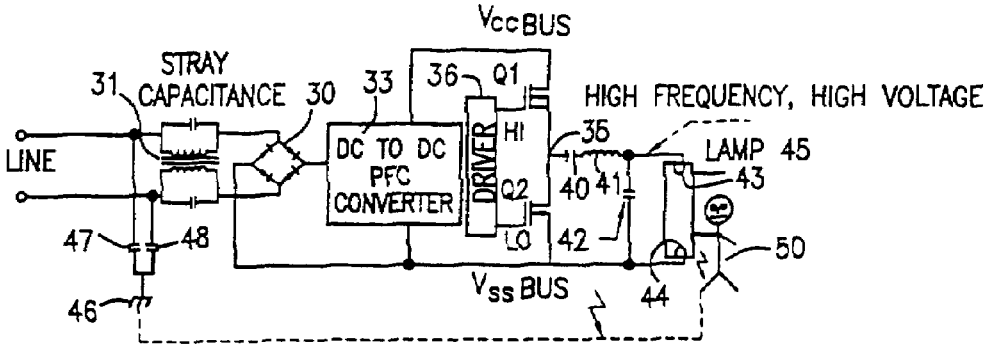
FIG. 1 (PRIOR ART)
FIG. 1 is a prior art electronic ballast circuit which presents a hazard in the presence of a high frequency, high voltage ground fault.

Referring to the drawings in which like reference numerals refer to like elements, FIG. 1 schematically shows a prior art electronic ballast circuit in which an AC input line is connected to a full wave bridge connected rectifier circuit 30 through a common mode choke 31. The windings of the common mode choke or inductor 31 both have stray capacitances associated therewith as shown. The output of bridge 30 may be connected to a DC-to-DC power factor converter circuit 33 which has one output connected to the $V_{SS}$ bus and another output to the $V_{CC}$ bus.

A high side switching MOSFET (or other MOS controlled device such as an IGBT) $Q_1$ is connected to the $V_{CC}$ bus and a low side switching MOSFET $Q_2$ is connected to the $V_{SS}$ bus. MOSFETs $Q_1$ and $Q_2$ are suitably controlled to alternately turn MOSFETs $Q_1$ and $Q_2$ on and off with controlled frequency, duty cycle and/or phase delay.

Output node 35 is then connected to a resonant load, which, in FIG. 1, consists of blocking capacitor 40, inductor 41, parallel capacitor 42 and fluorescent lamp 45 having filaments 43 and 44.

The line conductors in FIG. 1 are connected to ground 46 through capacitors 47 and 48. A hazard exists if, because of a ground fault or the like an individual 50 is connected between the circuit and ground.

The hazard caused by the low frequency (50/60 Hz) is generally treated with a residual current sensor (not shown). However, the high frequency (20-100 Khz) voltage used in electronic ballasts might be dangerous because the voltages are high (especially during the ignition period) and the gas in the tube behaves like a large capacitor.

Figure 2:
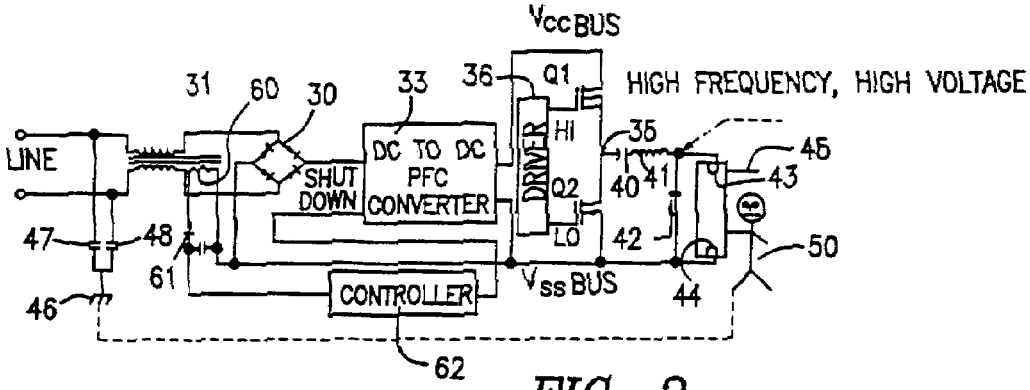
FIG. 2 shows a novel circuit to provide high frequency hazard protection and is an improvement of the circuit of FIG. 1.

FIG. 2 shows the novel circuit for avoiding the above hazard problem. In FIG. 2, those parts which are similar to those of FIG. 1 have identical identifying numerals. A novel additional winding 60 is added to the common mode choke 31. Winding 60 is connected through diode 61 to a controller 62 which is adapted to sense a fault condition. If winding 60 senses a common mode high frequency current higher than a safe value, controller 62 applies a "shut-down" signal to converter 33, thereby shutting down the DC/AC power bridge. Details of a typical converter and DC/AC power bridge which could be used with this invention are later described herein.

II. DC Filament Supply Circuit for Safe Parallel Lamp Operation.

Figure 3:
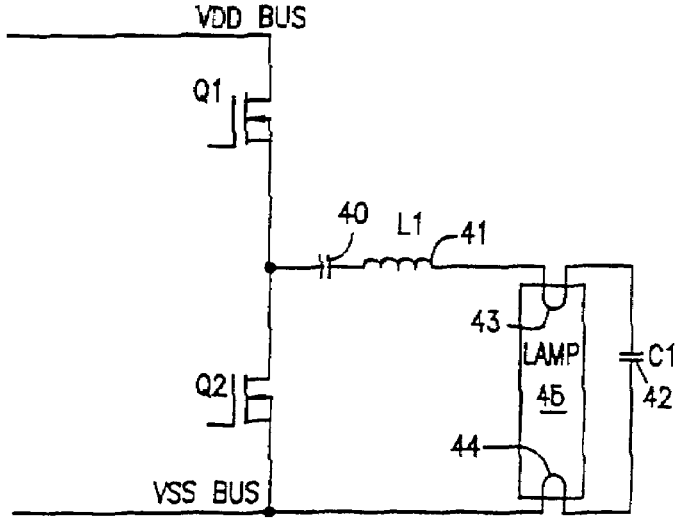
FIG. 3 (PRIOR ART)
FIG. 3 is a circuit diagram of a lamp ballast with a known serial connection of lamp filaments.

A fluorescent lamp has two filaments at its two sides. Thus, in FIG. 3, lamp 45 has filaments 43 and 44. These filaments must be heated before the lamp 45 can be ignited, and must remain heated if one wishes to operate lamp 45 at a "Low Light" or dimmed condition. There are two principal connections for lamp filaments used in electronic ballasts, a serial connection and a parallel connection. FIG. 3 shows the serial connection.

In this configuration the heating current flows through the resonance circuit formed by inductor 41 and capacitor 42. Prior to ignition and during a phase the voltage on the lamp should be low (under the ignition voltage). Therefore the operating frequency should be significantly above resonance. At that frequency the current is determined by inductor 41 and might be too low to produce adequate filament heating. At and after ignition the current through the filament is adequate.

Figure 4:
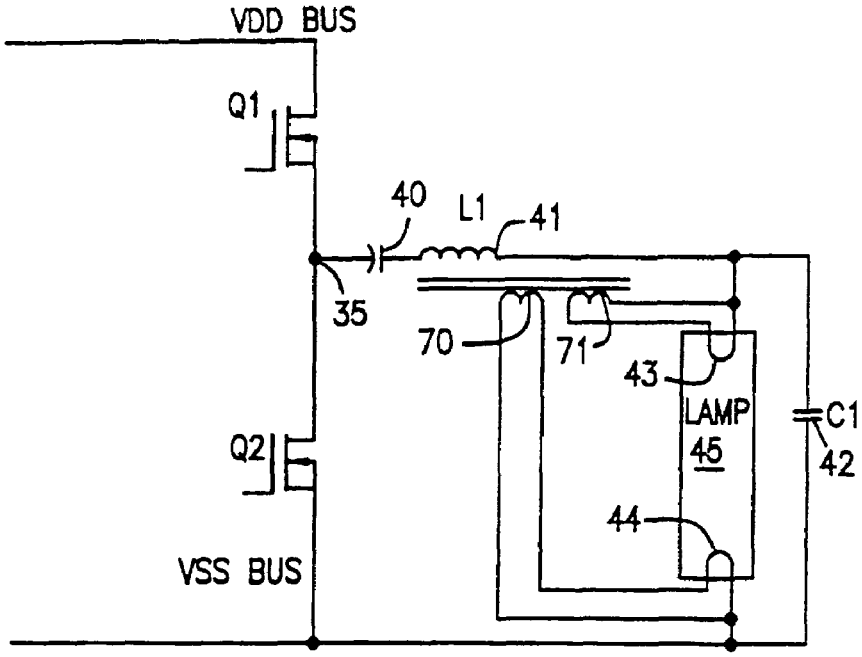
FIG. 4 (PRIOR ART)
FIG. 4 shows a circuit diagram of a lamp ballast with a known parallel connection of lamp filaments.

FIG. 4 shows a prior art parallel connection of filaments 43 and 44. In this configuration the inductor 41 has additional windings 70 and 71 which are used a supply a heating voltage to filaments 43 and 44 (rather than a series) current. This circuit provides an adequate current through the full lamp operating mode, but it has a serious drawback. That is, when a lamp is taken out of its housing, current still flows through the resonance circuit 41 and 42 and might damage the ballast especially when it is used to drive two parallel lamps.

Figure 5:
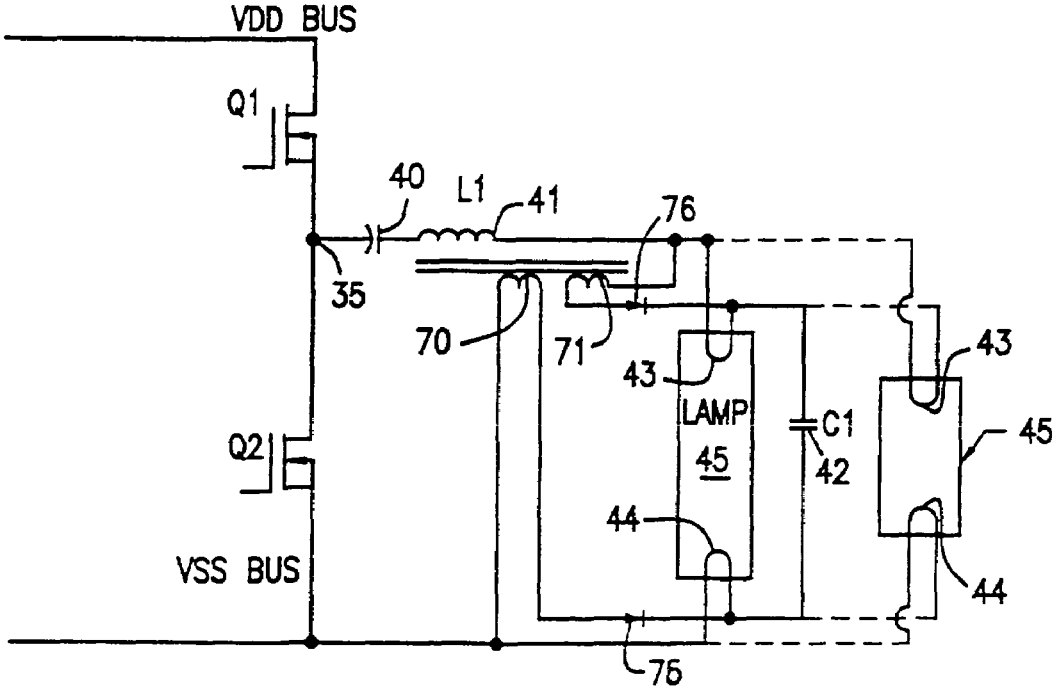
FIG. 5 shows an improvement of the circuit of FIGS. 1 and 4 and is a novel circuit arrangement for a lamp ballast employing a novel series/parallel connection of filaments.

In accordance with the invention, and as shown in FIG. 5, a novel series/parallel connection is provided. Thus, windings 70 and 71 of FIG. 4 are reconnected as shown and are connected to filaments 44 and 43 respectively through diodes 75 and 76 respectively.

This approach applies parallel heating to the filaments and connects the lamp in such a manner that pulling it out of the housing will open the lamp circuit.

The result is a serial-parallel combination, the parallel segment feeding the lamp 45 with a half wave rectified DC wave form. The diodes 75 and 76 are connected in such a manner that whenever the lamp 45 is pulled out, current flow is blocked.

The connection of a second lamp 45 is shown in phantom lines in FIG. 5. Under this arrangement, the removal of one of the lamps still allows the remaining lamp (or lamps where more than two lamps are driven) to operate. The removal of all lamps blocks the current flow.

III. Protective Circuits for the Bridge Inverter.

Figure 6:
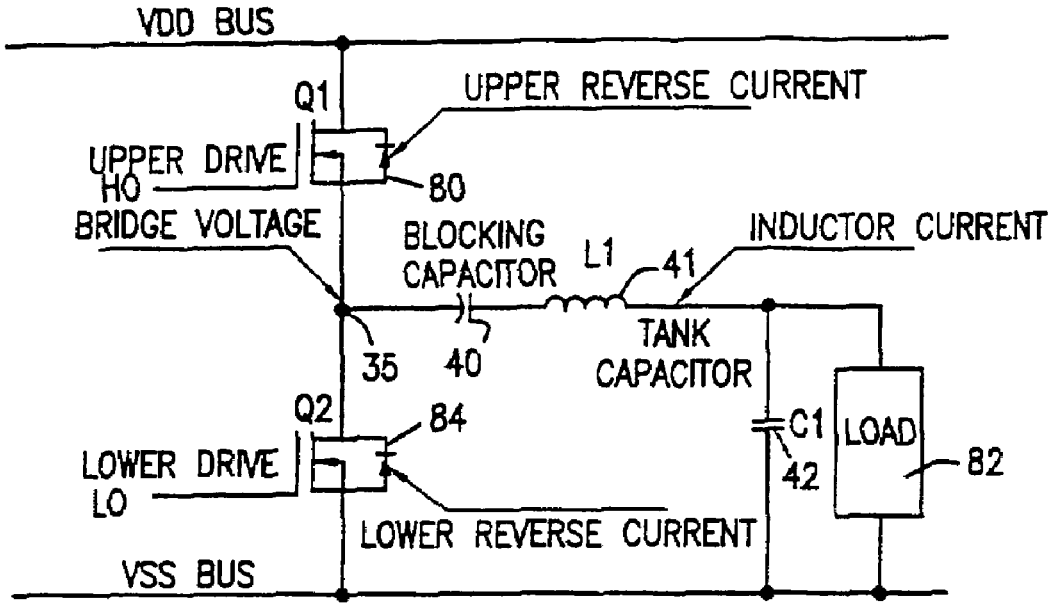
FIG. 6 (PRIOR ART)
FIG. 6 shows a known generic half-bridge ballast circuit operated in a near resonance operation.

FIG. 6 shows a "generic" half-bridge circuit for driving any desired resonant load, such as an electronic ballast. The half-bridge consists of the high side and low side MOSgated devices, and the like, such as MOSFETs $Q_1$ and $Q_2$ respectively. MOSFETs $Q_1$ and $Q_2$ are shown with conventional parallel body diodes 80 and 81 respectively and load 82 can be any desired resonant load such as gas discharge lamp. Basically the circuit of FIG. 6 is a resonant topology and the work regime is near resonance; that is, close to the resonant frequency of inductor 41 and capacitor 42. The invention to be described is suitable for any application in which a reactive current might flow through the bridge $Q_1$, $Q_2$. Note that everything described below applies to a full bridge topology as well as the half-bridge shown in FIG. 6.

Figure 7:
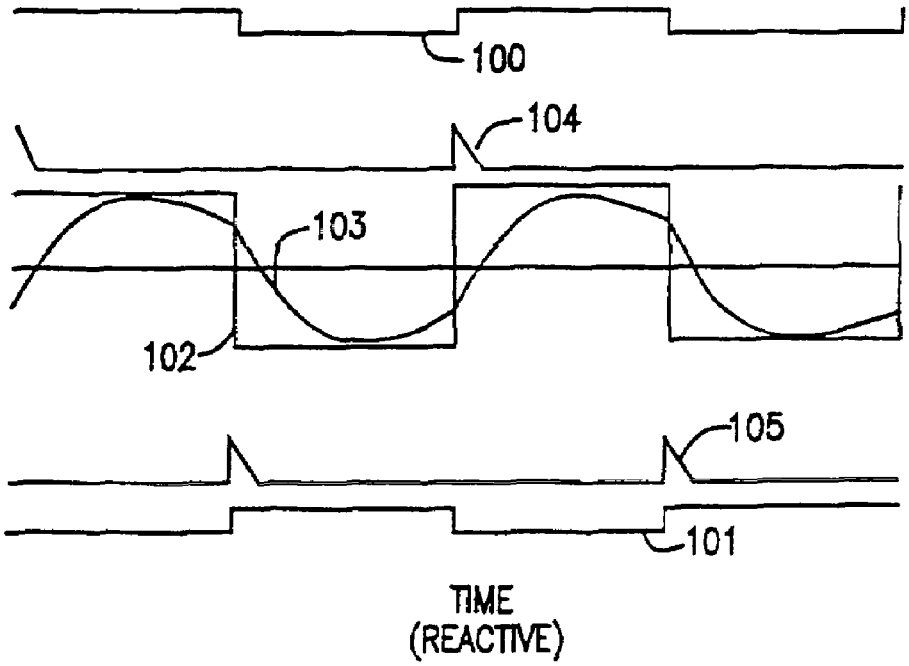
FIG. 7 shows the voltages and currents in the circuit of FIG. 6 on a common time base for a reactive phase condition.

FIG. 7 shows relevant voltages and currents in the circuit of FIG. 6 on a common time axis when the excitation frequency of MOSFETs $Q_1$ and $Q_2$ is above the resonant frequency of inductor 41 capacitor 42 and load 82. In this condition the load is reactive. In FIG. 7, line 100 is the HO signal to $Q_1$ and line 101 is the LO signal to $Q_2$. The bridge voltage at node 35 is shown by line 102 and the bridge current is shown by line 103.

At the end of each excitation cycle in FIG. 7, the current 103 through the inductor 41 lags behind the excitation voltage 102. When the upper switch $Q_1$ is closed, a current flows into the inductor 41. When the upper switch $Q_1$ opens or turns off, the current must continue flowing through the inductor 41 and does so by flowing through the lower switch integral diode 81 as shown by line 104 in FIG. 7. When the lower switch $Q_2$ closes $Q_2$, the integral diode 81 recovers from conduction at a zero voltage by a recombination of carriers effect only.

The same behavior described above applies to the half cycle controlled by lower switch conduction line 105.

The following can be observed:

1. When upper switch $Q_1$ is turned off, the inductive current is steered to the lower switch integral diode 81 and the voltage 102 at the bridge swings immediately from Vdd to Vss.

2. The current steered into the lower switch integral diode 81 collapses to zero while the lower switch $Q_2$ is closed.

3. Simultaneous conduction of both upper and lower branches $Q_1$ and $Q_2$ and of the bridge is not possible.

Figure 8:
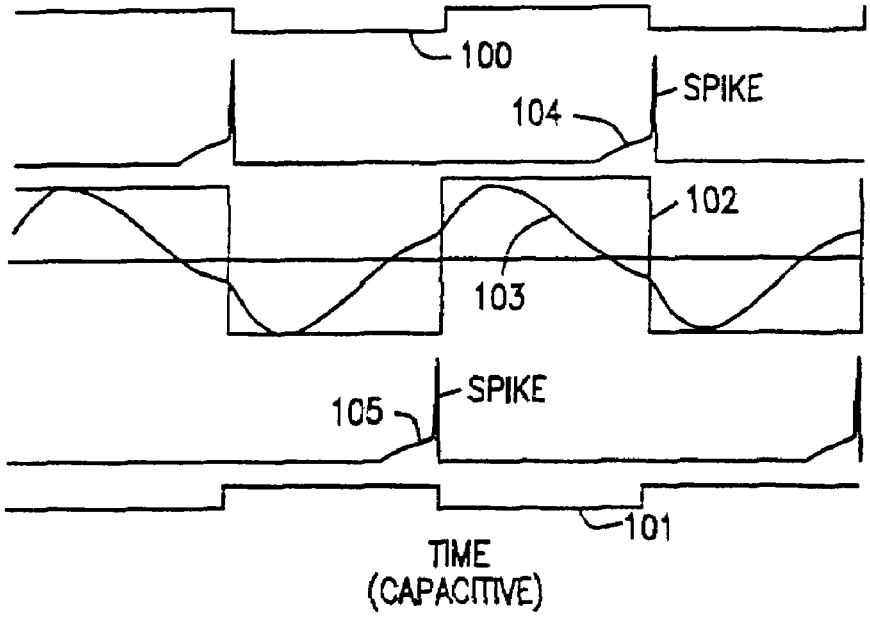
FIG. 8 shows the voltages and currents in the circuit of FIG. 6 for a capacitive phase condition.

The diagram of FIG. 8 shows the behavior of the inverter bridge of FIG. 6 when the excitation frequency is below resonance (and the load is therefore called capacitive). The various traces of FIG. 8 have the same numerals as those of FIG. 7.

At each excitation cycle the current through the inductor 41 leads the excitation voltage and reverses its direction before the excitation cycle ends. Thus at the end of the excitation cycle the current flows through the integral diode of the power switch $Q_1$ or $Q_2$ which is turned on and which is about to close. When the upper switch $Q_1$ is closed, current still flows through its integral diode 80. When the lower switch $Q_2$ closes the current still flows through upper integral diode 80; therefore it recovers at a full DC bus voltage through a forced recovery process, which is harsh. This forced recovery process causes a momentary short circuit condition with a high current spike (labeled in line 105 of FIG. 8) and may lead to a device failure.

The same behavior applies to the lower switch of FIG. 6.

The following can be observed for a capacitance condition:

1. When upper switch $Q_1$ is driven "Off" the current through the inductor 41 flows into the upper switch integral diode 80 due to current direction reversal that occurs before the excitation ends.

2. The bridge will stay at Vdd level until the collapse of the current flowing from the inductor 41 to the integral diode 81 or until the lower switch $Q_2$ is driven into conduction.

3. If the lower switch $Q_2$ is driven into conduction while the upper switch internal diode 80 is still carrying current, it will be driven into a harsh recovery which may damage the device.

4. The same phenomenon can be observed at the lower switch $Q_2$ conduction period.

The problem of simultaneous conduction caused by a harsh recovery is commonly corrected by inserting an intentional dead time which is a period in the cycle in which none of the switches are driven into conduction. The dead time should be long enough to provide protection for the switching devices, but, on the other hand, inserting a large dead time will deteriorate the performance of the bridge by limiting the duty cycle. It also limits the ability of the bridge to operate near resonance. Thus, the common solution is a compromise offering insufficient protection at the cost of limited performance.

In accordance with the invention, a variable dead time is provided that adapts itself to circuit needs. This dead time is termed a "dynamic dead time." The dynamic dead time is achieved by sensing the point where the current collapses to zero in a capacitive case. There are four variants:

1. Sensing the current through the inductor 41 by a current transformer or a shunt resistor in series therewith.

2. Sensing the current through the switching devices $Q_1$ and $Q_2$.

3. Sensing the bridge voltage.

4. Sensing the rate of rise (dv/dt) of the bridge voltage.

Figure 9:
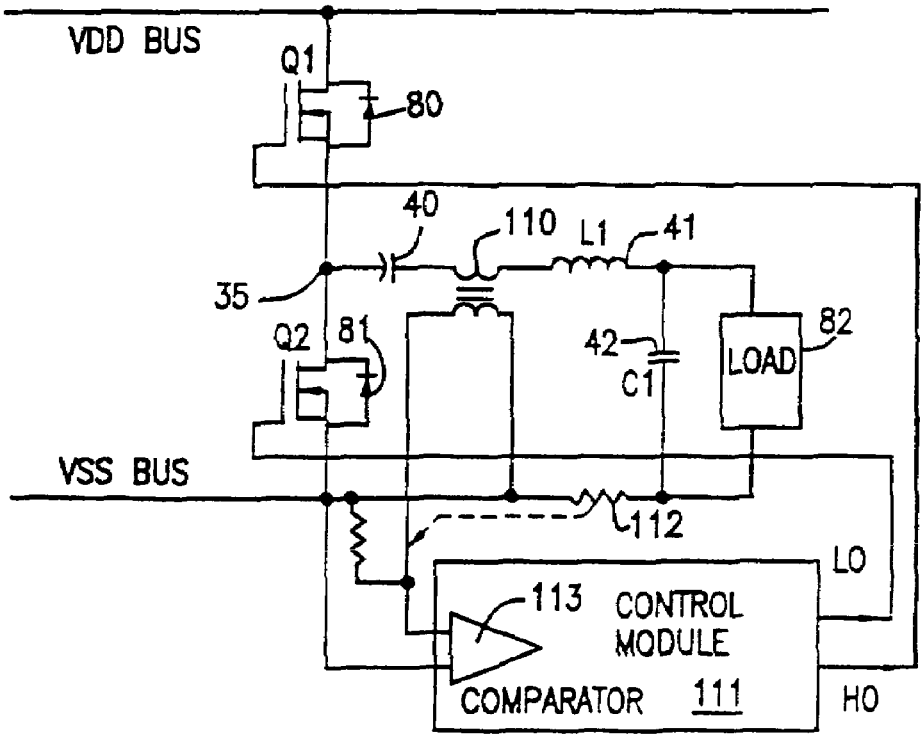
FIG. 9 shows the circuit of FIG. 6 adapted with a novel current sense protection circuit.

FIG. 9 shows the use of a current sense protection circuit in which a current transformer 110 is provided to monitor the bridge current. FIG. 9 also shows the control module 111 which provides the LO and HO outputs to MOSFETs $Q_2$ and $Q_1$ respectively. This current measuring function can also be carried out by current transformers (not shown) in series with $Q_1$ and $Q_2$ or by the shunt resistor 112 in the Vss Bus. These current measurement devices are then connected to comparator 113 in control module 111. Any "ringing" sensed by comparator 113 close to the end of the current conduction period can be controlled by a regenerative circuit such as a Schmidt trigger, a flip-flop or a bus-holder.

Figure 10:
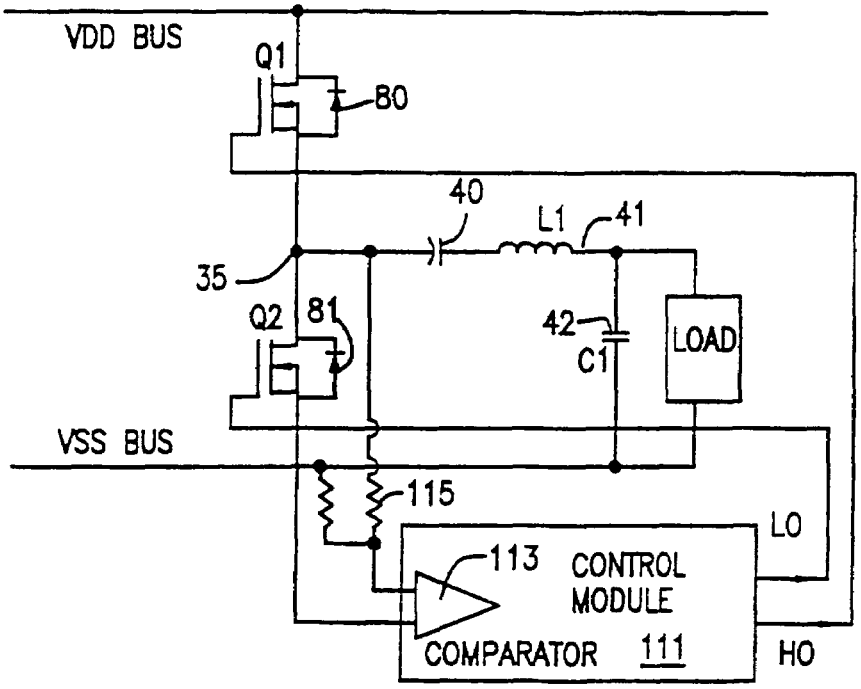
FIG. 10 shows the circuit of FIG. 5 with a novel voltage sense protection circuit.

FIG. 10 shows the circuits of FIGS. 6 and 9 modified for a voltage sense protection mode. Thus, in FIG. 10, a connection is made from node 35, through resistor 115 to comparator 111.

The operation of the circuit of FIG. 10 is described in the following:

1. An inversion of the bridge voltage at node 35 occurs at the point that the current collapses to zero in a case of "capacitive" operation of the bridge (line 103 in FIG. 8).

2. That inversion is sensed by means of a voltage comparator (line 102, FIG. 8). A dead time is inserted from the period of the switch being closed till the inversion of bridge voltage (line 102, FIG. 8).

3. Any "ringing" sensed by the comparator 113 near the end of the current conduction period can be controlled by a regenerative device such as a Schmidt Trigger or flip-flop or a bus holder (not shown).

4. When the bridge operates in an inductive zone (FIG. 7) the inversion of the voltage occurs immediately after closing a switch; and therefore a dead time is not inserted.

Figure 11:
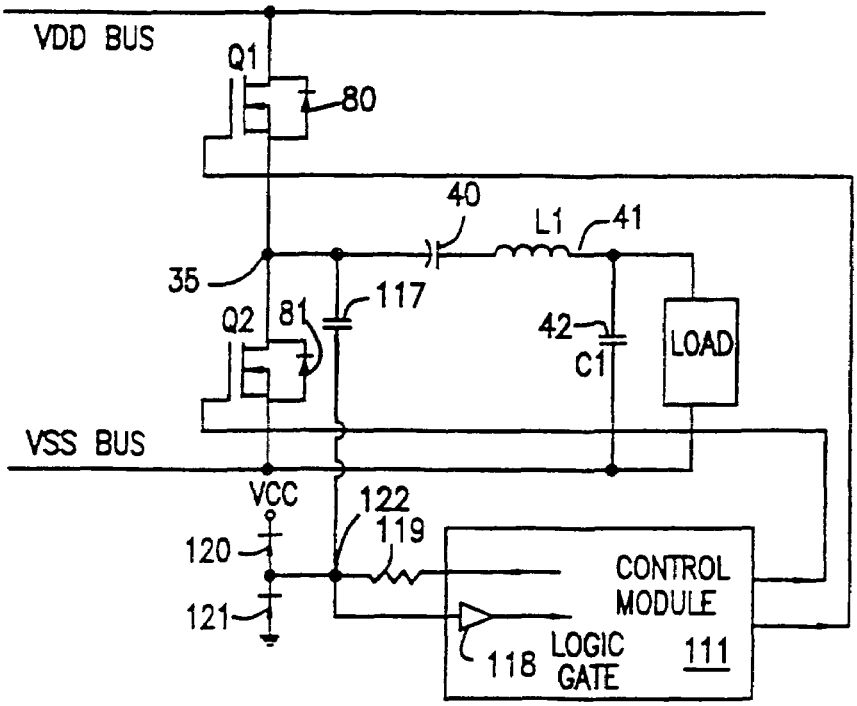
FIG. 11 shows the circuit of FIG. 6 with a novel dv/dt sense protection circuit.

FIG. 11 shows a dv/dt sense protection scheme which provides a capacitor 117 coupled from node 35 to a logic gate 118 within control module 111. A control module connection is provided from resistor 119 to a node between diodes 120 and 121.

The circuit of FIG. 11 is a modification of the voltage sensing control of FIG. 10 and is suitable for digitally controlled DC/AC Bridges. This embodiment uses a logic gate 118 instead of the comparator 113, which is basically an analog device.

As long as the voltage is rising a current flows through the sensing capacitor 117 and is clamped to VCC. At a falling voltage capacitor 117 is clamped to the control circuit. When the voltage of the bridge does not rise or fall, the input of the logic gate 118 might float and, therefore, it is held to an appropriate value by the control logic.

It is possible to use a continuous reactive load protection arrangement in which the DC/AC bridge of FIG. 6 is operated in a continuous capacitive regime, rather than providing protection only.

When the dead time is being determined automatically by the current or voltage commutation, the operation of the bridge tends to be irregular, which means that the bridge might be driven into asymmetrical operation and the current waveform will be irregular.

Figure 12:
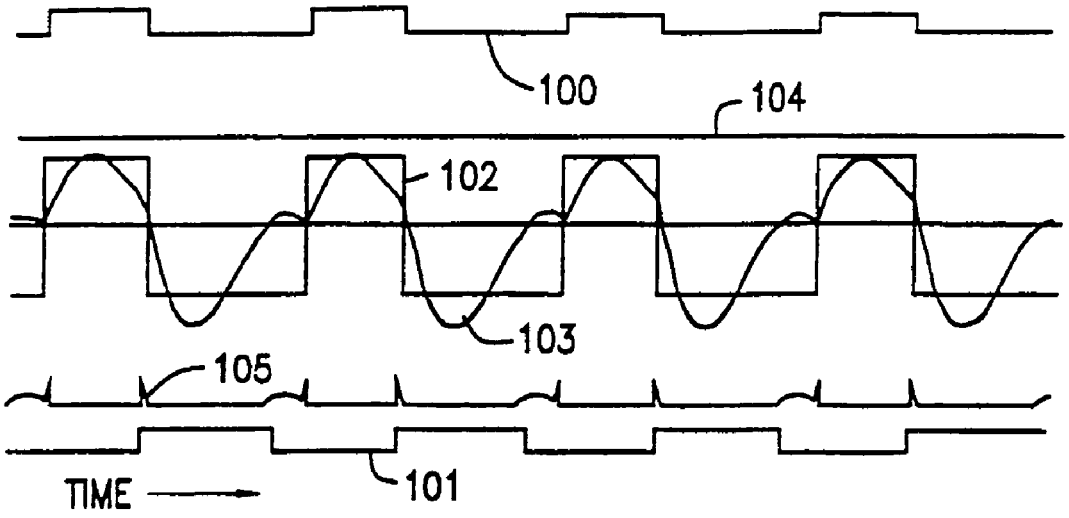
FIG. 12 shows the curves of FIG. 8, using a novel continuous reactive load mode of operation.

A simple case of such an irregularity is shown in the wave forms of FIG. 12 which shows the curves of FIG. 8 but containing the irregularity.

Figure 13:
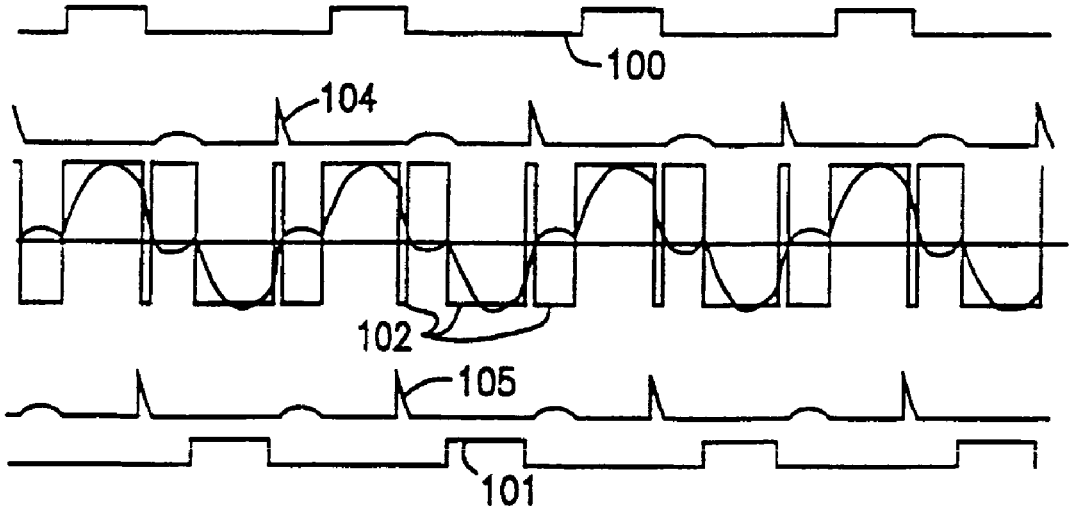
FIG. 13 shows the curves of FIG. 12, modified by a novel use of predicted minimum dead time.

This irregular operation could be corrected by using the previous (measured) dead time to predict a minimum dead time for the cycles to come, and sense the current or voltage afterwards, as shown in, FIG. 13.

Figure 14:
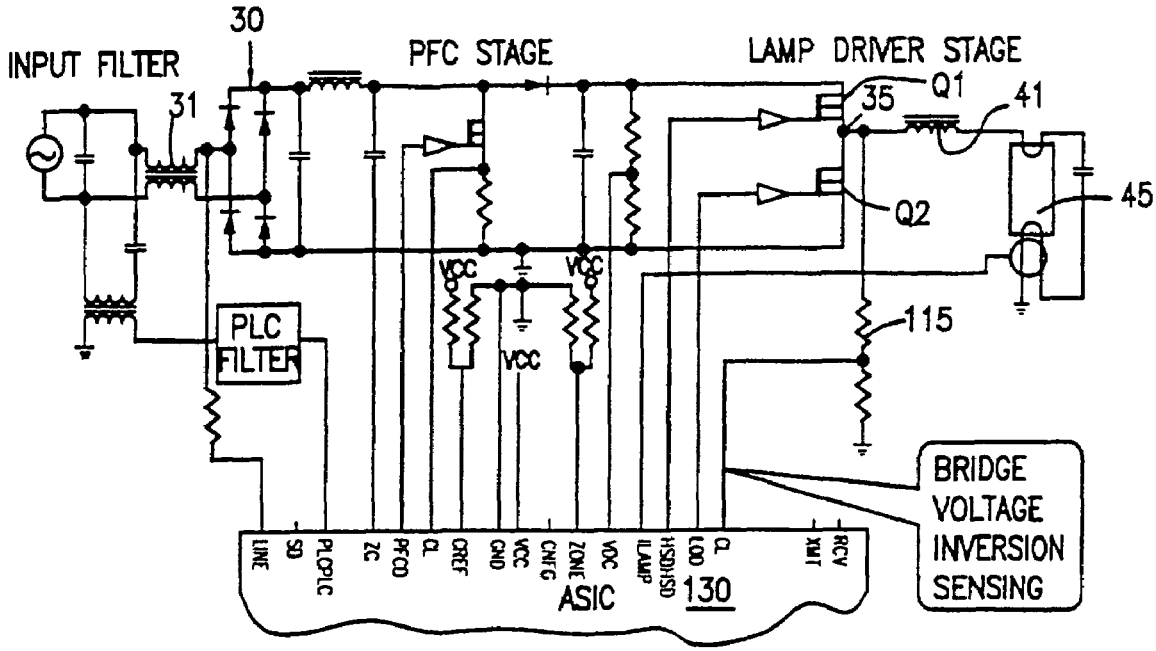
FIG. 14 shows a novel voltage sense protection circuit (FIG. 10) for an electronic ballast.

FIG. 14 shows a specific circuit diagram of a voltage sense protection system for a fluorescent lamp ballast (FIGS. 3 and 10) in conjunction with a specific ASIC 130 for providing all control signals.

In FIG. 14, the inversion of the bridge voltage at node 35 is sensed by an internal voltage comparator (within ASIC 130) at Pin CT and is used by internal logic to expand the dead time.

Note that the voltage sensing method shown in FIG. 14 overcomes delays caused by bus capacitance in the capacitive lead detection circuits.

Figure 15:
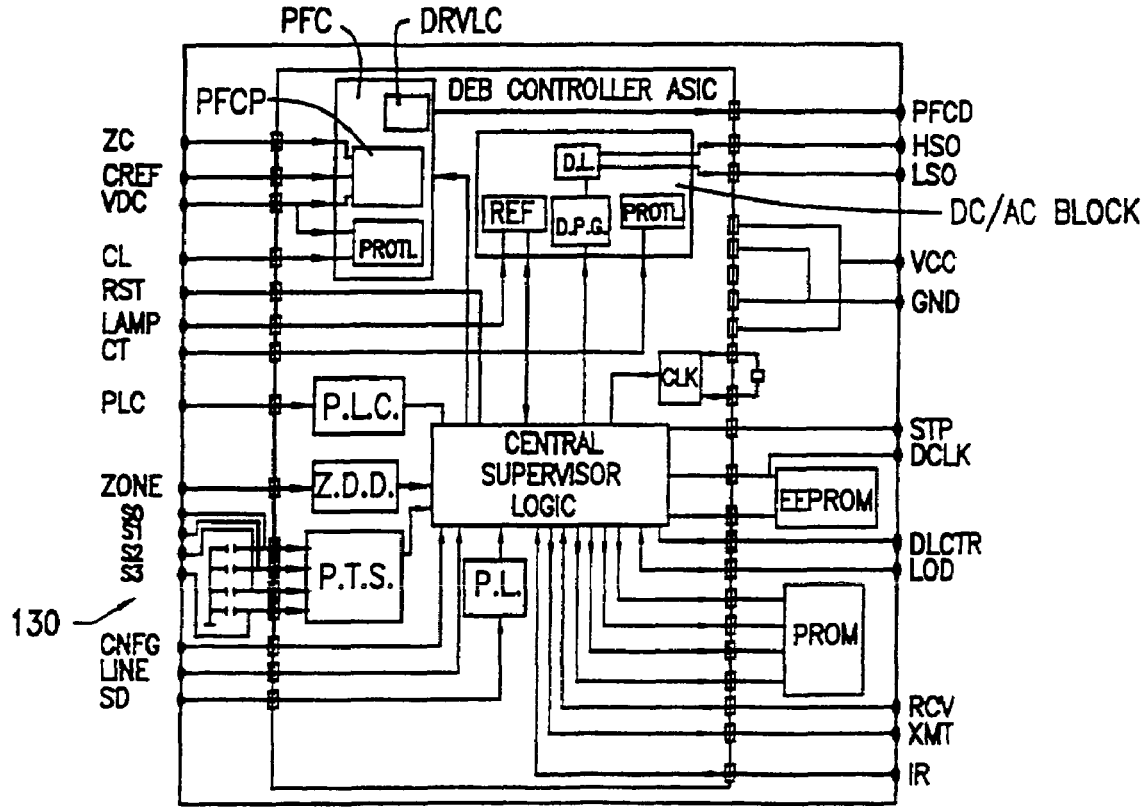
FIG. 15 is a block diagram of a preferred ASIC which can be used to control the circuit of FIG. 14.
Figure 16:
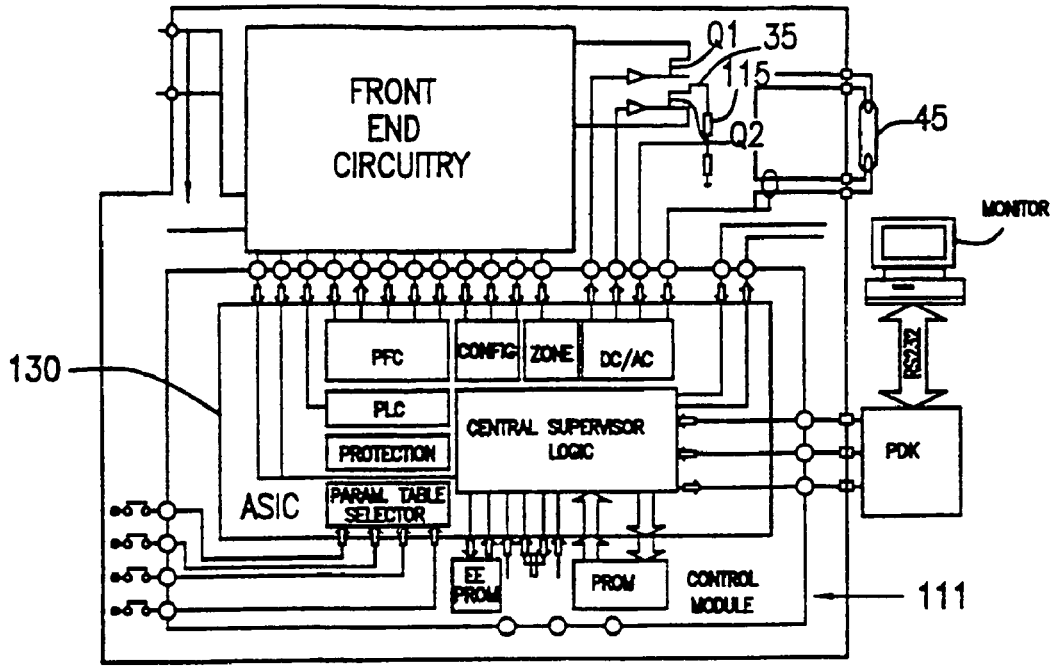
FIG. 16 is a block diagram of a full control module using the circuits of FIGS. 14 and 15.

FIG. 15 is a block diagram of the ASIC 130, which will later be more specifically described. FIG. 16 shows the full control module, including the circuits of FIGS. 14 and 15.

IV. The DC to AC Inverter Bridge for Non-Linear Loads.

The following describes a novel process for operating the DC to AC inverter bridge of FIG. 6, which drives a non-linear, resonant, and time varying load, for example, electronic ballasts for low-pressure and high pressure lamps, resonant power supplies, laser power supplies, and the like.

There are two common control methods in use; pulse width modulator (PWM) and frequency modulation (FM) control. Both methods provide only partial solutions for the problem that those power supplies present. The problem arises when the control circuit tries to achieve a goal of low light level (for example, very low dimming) at a small current. Trying to reach a low current using a PWM circuit could drive the DC/AC bridge into the capacitive area and can lead to the destruction of the power switches $Q_1$ and $Q_2$. On the other hand trying to do so by varying the frequency usually leads to an irregular light output (rings or snakes in fluorescent lamps) and instability.

Although not shown in FIG. 16, the various modules in ASIC 130 are interconnected within the ASIC (see FIG. 15) to a central logic supervisor. The central logic supervisor controls the overall operation of ASIC 130 by facilitating communications and passing data between modules.

According to the control method of the invention, both pulse width and frequency modulation are employed and are constantly varied in order to dim the lamp and/or to maintain a high quality control regime. The goal is to work as close as possible to resonance but to be at the inductive behavior shown in FIG. 7, under transients, lamp aging, malfunctions, use of a non-compatible lamps, etc. The novel method is combined with a center tap protection solution that prevents, "pulse by pulse", being accidentally reflected into the inverter's bridge as the capacitive load, shown in FIGS. 12 and 13.

Figure 17:
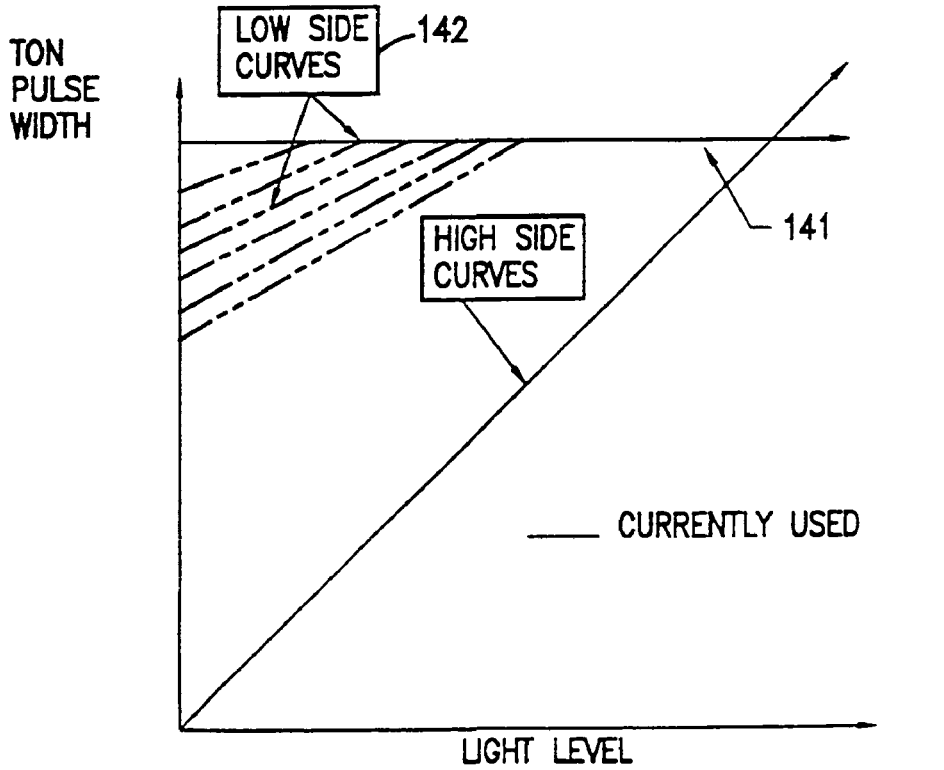
FIGS. 17 and 17A show the curves for the novel independent control of the high side and low side switches of a DC/AC bridge inverter.
Figure 17A:
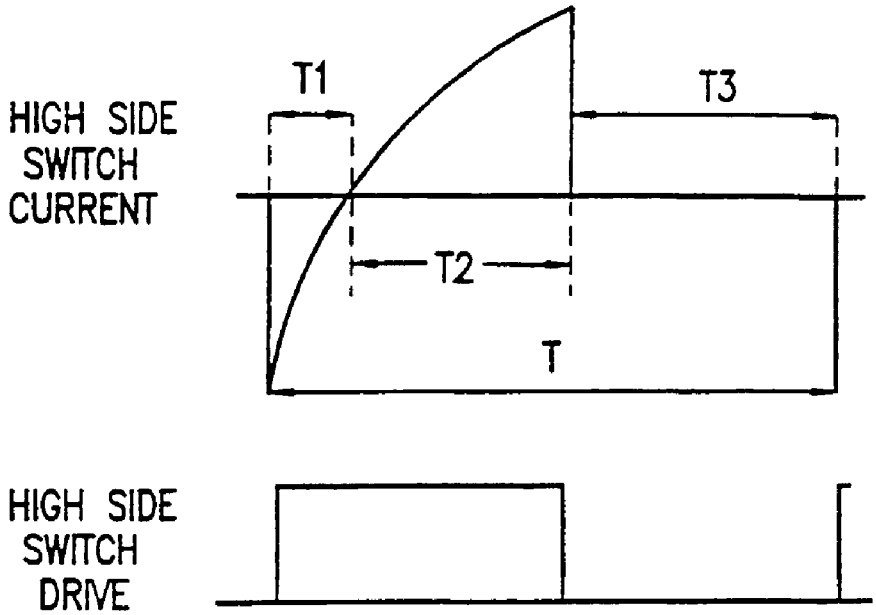

The novel algorithm for controlling the bridge when used for dimmable electronic ballasts, controls the preheat, ignition and dimming control functions. In a particular case, at high light levels a constant width pulse is used for the lower switch $Q_2$ of the bridge, and a pulse of variable width is used for the upper switch $Q_1$. This control scheme is shown in FIG. 17 which shows light level as a function of pulse width Ton for the high side and low side switches $Q_1$ and $Q_2$ in FIGS. 6 and 14 to 16. At the present time, low side curve 141 is employed for constant pulse width, but any of the alternates curves 142 can be used. FIG. 17*a* further explains the high side switch behavior shown in FIG. 17. In FIG. 17*a*, the terms shown are defined as follows:

T—Full period of the half bridge

T1—High side switch reverse current time

T2—High side switch "legal direction" conduction time

T3—Low side switch conduction time

As explained above, the aim of the half-bridge drive algorithm is to keep the half-bridge load inductive but close to resonance at all operation regimes.

The novel method is to drive the switches under reverse (parallel diode) conduction, when switch voltage is close to zero. For example, the high side drive rising edge must come during the T1 time frame.

The algorithm must keep time T1 short in order to be close to resonance but never zero or negative which is the expression for capacitive load to the half bridge.

Through all operation regimes, the algorithm provides high and low side drives that preserves a short fixed T1, during steady state conditions. If however, during transients the T1 shortens and gets close to zero, then, the center tap mechanism will bring it back to a safe length or duration.

In addition, the dead time between upper and lower switch operation is controlled simultaneously. For low light levels, this method is too coarse and a method of variable width is simultaneously applied also to the lower switch $Q_2$ operation.

As a general rule, the novel method allows independent control of each one of the bridge switches $Q_1$ and $Q_2$ (or pairs of switches in case of full bridge) in a zero voltage switching full protected mode.

The stability of the control is achieved by changing the time constant of the DC/AC bridge control through the different operation regimens. A small time constant is used (fast control) when the light level is changed on request and a larger time constant (slow control) is used at steady state (fixed) light control. This method avoids overshoots or undershoots and light fluctuations respectively.

Figure 18:
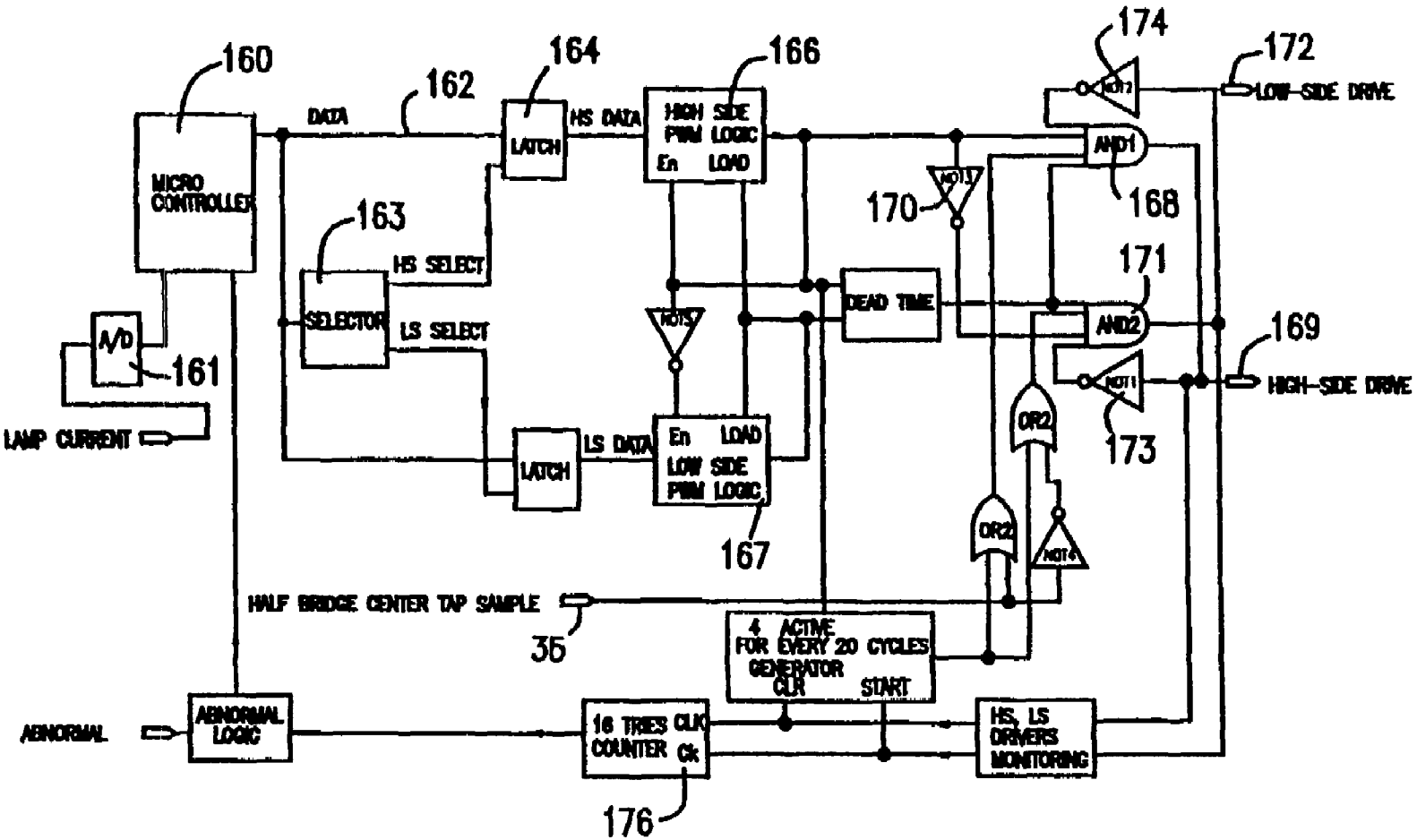
FIG. 18 is a block diagram of the silicon topology of the ASIC of FIGS. 14 and 15.
Figure 19:
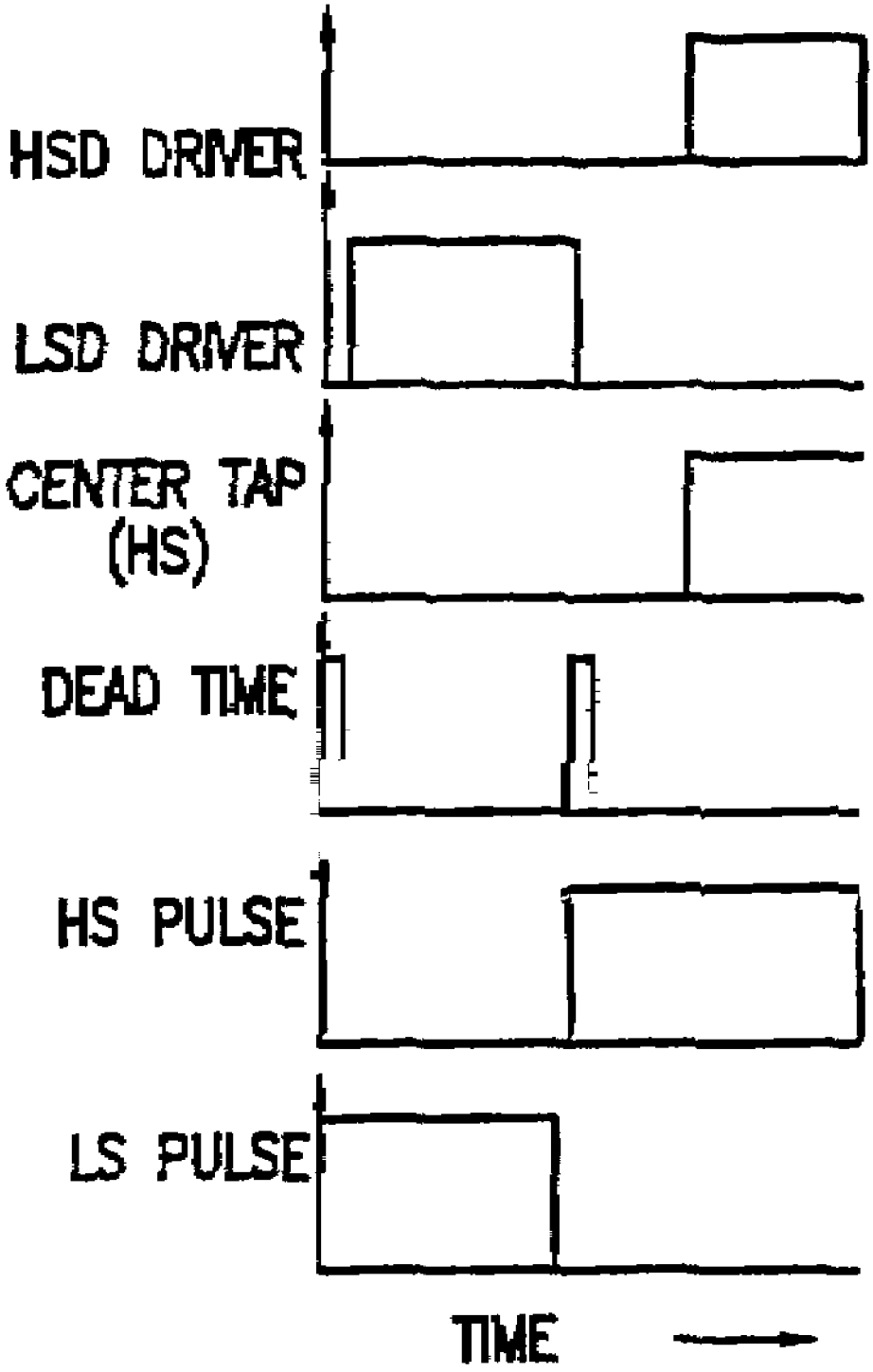
FIG. 19 shows relevant voltage and current curves produced by the ASIC of FIG. 18.

The ASIC 130 of FIGS. 14, 15 and 16 carries out the control scheme described above. A further block diagram of the silicon topology that controls switches $Q_1$ and $Q_2$ of the bridge, including center tap protection is shown in FIG. 18. FIG. 19 shows the control pulses produced by the circuit of FIG. 18 on a common time base.

The following is a description of the operation of the block diagram of FIG. 18 and the curves of FIG. 19.

1. A lamp current sample is provided to microprocessor 160 through A/D converter 161 (also included in ASIC 130).

2. Microprocessor 160 processes all information and provides one DATA BUS 162 that includes all processed information (PLC, PFC, DC/AC).

3. Selector 163 latches appropriate data into the appropriate LATCH 164 and 165. The rate of relatching is a decision or default of the software.

4. Counters "High Side PWM LOGIC" and "Low Side PWM LOGIC" together create the HIGH SIDE waveform (FIG. 19) that can be described as a pulse train. The pulse width is determined by "HS DATA" and "LS DATA" which determine the time between pulses.

5. The HS waveform is fed into AND1 gate 168. Fixed dead time and also variable dead time (determined by the center tap input) is added to the waveform which then exits through the HSDV (High Side Driver) output 169.

6. The waveform is also inverted by NOT3 gate 170 and fed to AND2 gate 171. Fixed and variable dead time is added to the waveform which then exits through the LSD (Low Side driver) output.

7. NOT1 and NOT2 gates 173 and 174 respectively avoid the possibility of the 2 outputs HSD and LSD respectively being both "High" at the same time.

8. Description of center tap protection circuit:

The outputs of AND1 an AND2 168 and 171 respectively, are monitored. If there is no overlapping with the original waveform (as getting out from HS PWM Logic) for 16 consecutive pulses, then the 16 tries counter 176 increases by 1, enabling 4 consecutive cycles with no interrupting. If the same phenomenon repeats itself the 16 tries counter 176 continues to increase. If the phenomenon disappears the 16 tries counter 176 is reset.

If the 16 tries counter 176 reaches 16 it sends an "Abnormal" message to the microprocessor 160 and enters an abnormal protection regime.

It should be noted that the above technique is applicable to a full-bridge as well as a half bridge.

In order to achieve a smooth change of light output, a variable depth "dithering" technique is applied in the variable width pulse mechanism through the entire lamp dimming work line.

Thus, using a digital control for the upper or the lower switch pulse width by a simple PWM procedure will cause the light to flicker. To smooth the steps of the light control, a dithering method can be used. Thus, a PWM of an average level which lies between PWM steps (defined by an integer number) is composed of a mixed sequence of pulses made from these two time steps.

Figure 20:
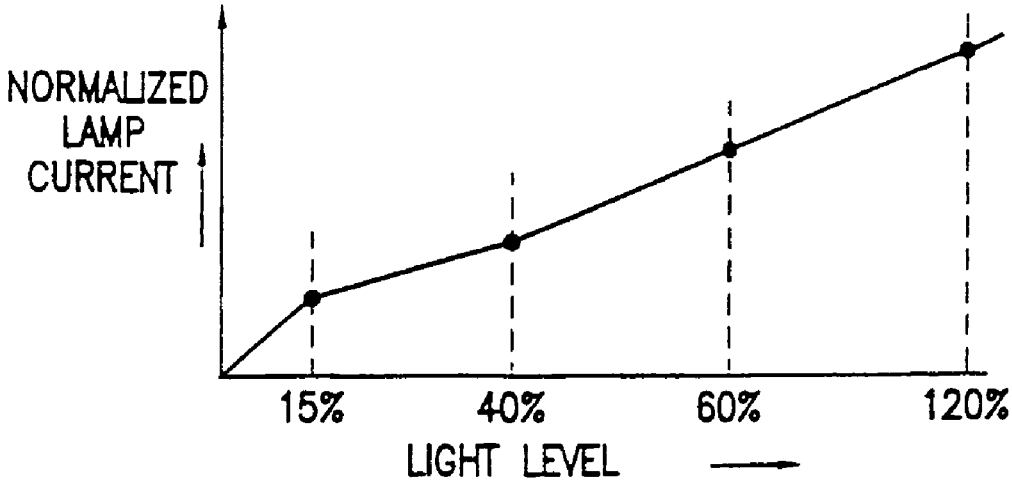
FIG. 20 is a diagram of light level versus current in which the curve is divided into matched segments of the conventional non-linear curve.

Precise light level control is achieved by measuring the lamp current only. This method is implemented by matching the current versus light-level non-linear curve into linear segments. Each segment enables a ratio between percentage of light-level and the lamp current, allowing a very precise light level control as shown in FIG. 20. This technique avoids the need for a complex lamp power or current measurement algorithm for each type of lamp to characterize the above non-linear behavior. Light control accuracy can be further increased by adding additional linear segments to the matched current versus light-level non-linear curve.

This method is implemented by using a dedicated parameter table that can be set or defined by the user. The above ratio is between the light level and the current at certain points (the extremes of each segment).

It is instructive to now summarize the principles adopted in algorithms used in the control method of the DC/AC inverter bridge for extreme non-linear AC load. Consider an extreme non-linear load, particularly for a gas discharge lamp that behaves like a negative impedance throughout most of its dimming range. These lamps have a transfer function whose gain varies between wide limits and it is therefore difficult to attain fast and smooth control. There are two common methods for controlling such a load through an AC bridge: pulse width modulation (PWM) and frequency (FM). Both are effective only within some sub-range of the load being controlled.

The control method described uses a PWM whose frequency and dead times are variable. It is applied in a half/full bridge topology: high side pulse width, low side pulse width with dead times between them are programmed and applied in a manner designed to achieve stable, smooth control loop throughout the whole range of no load to full load.

The method used suggests working near resonance at all loads but always keeping the load just a little above resonance. This is done first by providing best open loop control behavior (minimum gain variation) at every joint of the load regime. Pulse width and frequency are manipulated in a manner that achieves a constant open loop gain (sometimes the PWM is used to increase load current and the frequency used to decrease it and vice versa). These manipulations are performed according to the load V/I characteristics.

The following is an example of an embodiment in a ballast application. The control of dimmable discharge lamps over the full dimming range is based on a control range that is divided into three portions by two breaking points:

1. PWM control is used from minimum load to the first breaking point: the high side pulse increases and the low side pulse decreases. The total periodic time is kept at a fixed number.

2. Fix the low side and PWM the high side pulse from the first breaking point to second breaking point. The duty cycle is increased and at the same time frequency is decreased.

3. Frequency control is used from the second breaking point to maximum load both high side and low side pulses increase.

This method creates an open loop work-line with minimum gain variation and minimum predetermined dead time between pulses. This will best control a predictable load (e.g., a lamp with normal operating behavior). In order to prevent failures caused by unpredictable behavior of the load, the center-tap voltage of the bridge is sampled to ensure that switching is at zero voltage. Pulses are dynamically chanced to protect against destructive currents. Dead time is increased dynamically to the zero voltage point. This feature of the method enables working at high frequencies with very short predetermined dead time for a lamp with normal operating behavior. In addition, its permits increasing the dead time in the event of transients and changes in load behavior, for example, as the discharge lamps age.

V. A Digital Implementation of a Power Control Circuit.

Figure 21:
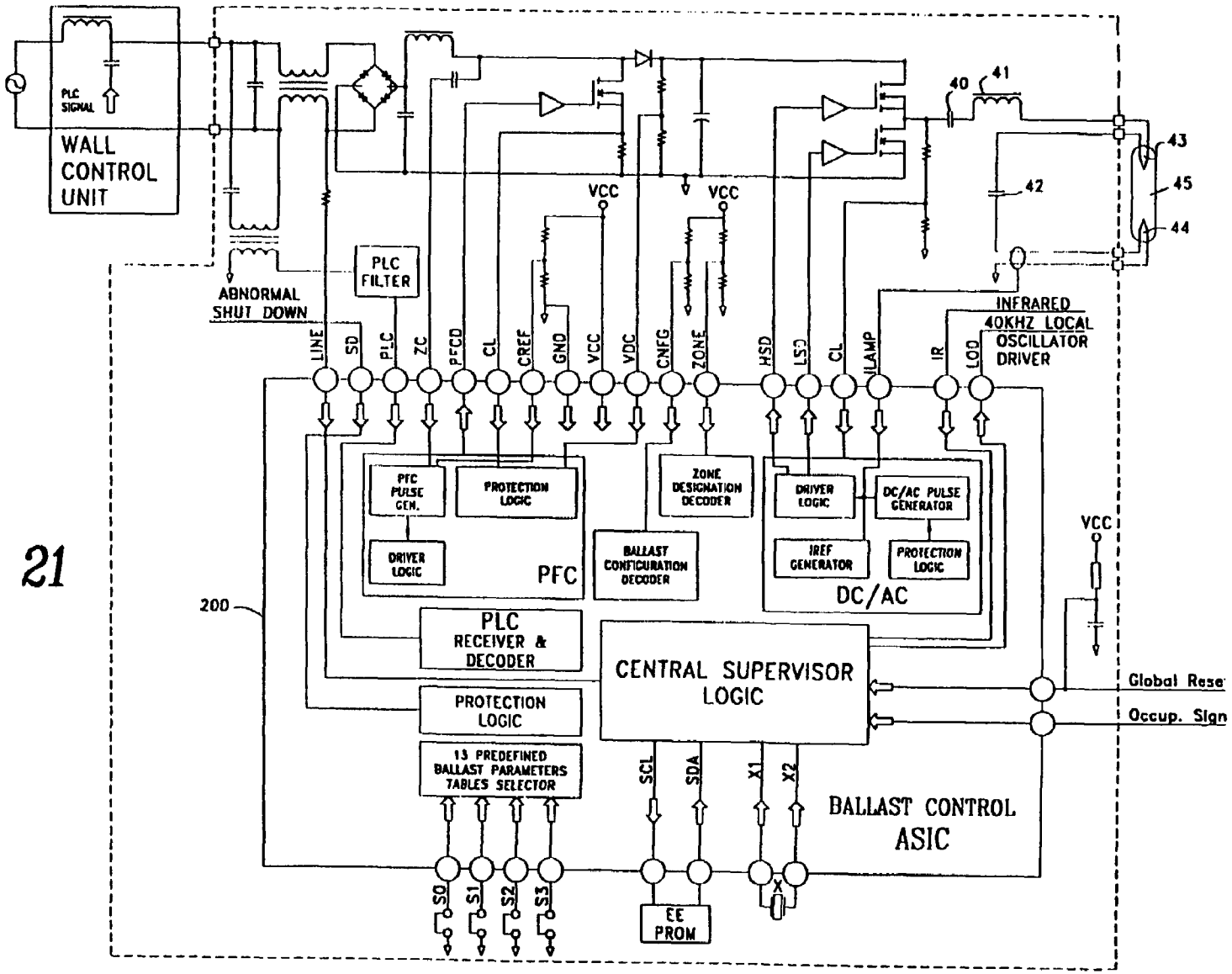
FIG. 21 is an interconnect diagram of a PLC Remote Controlled Dimmable Ballast.
Figure 21A:
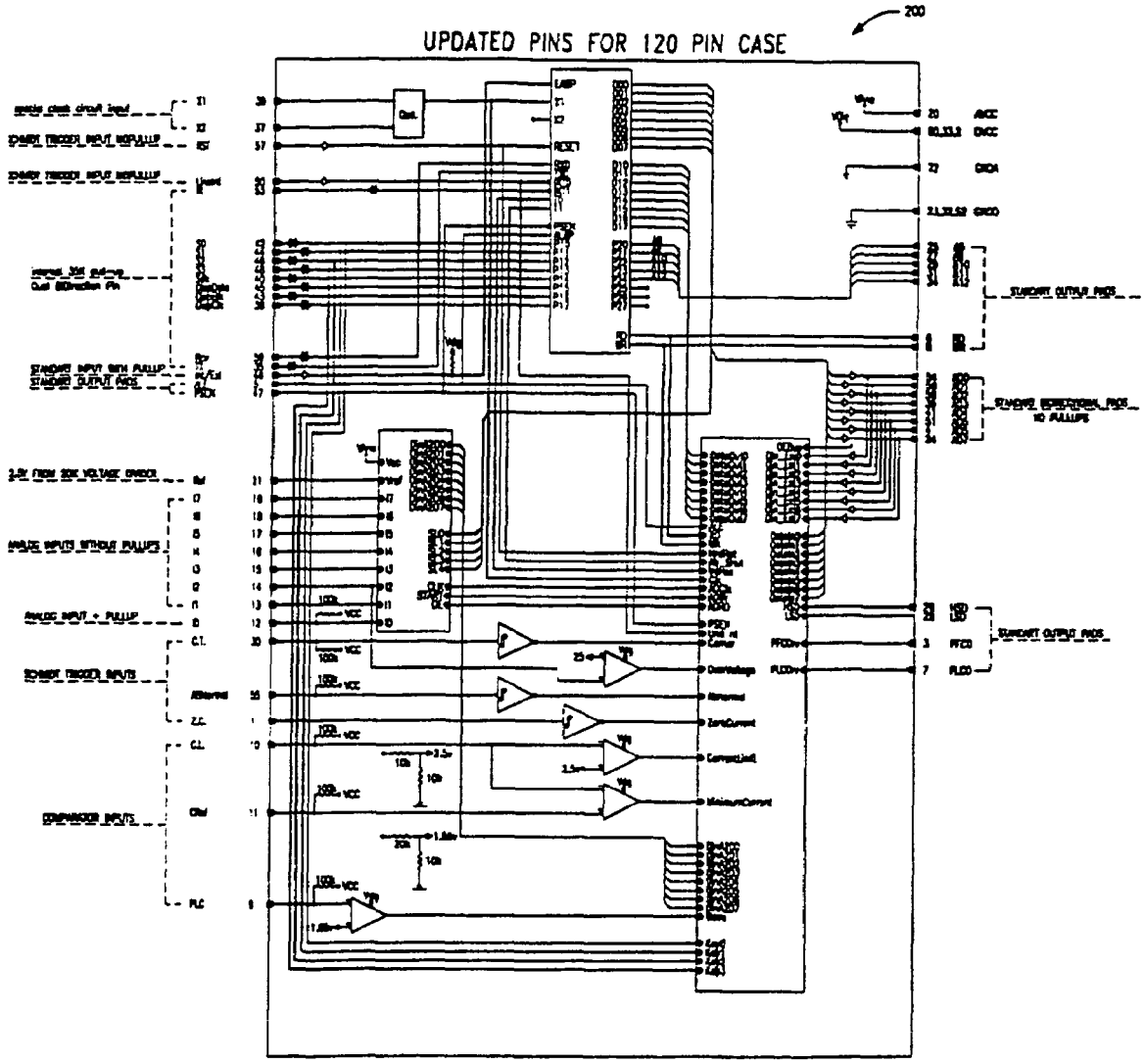
FIG. 21A is a schematic diagram of the ASIC used in FIG. 20.
Figure 23:
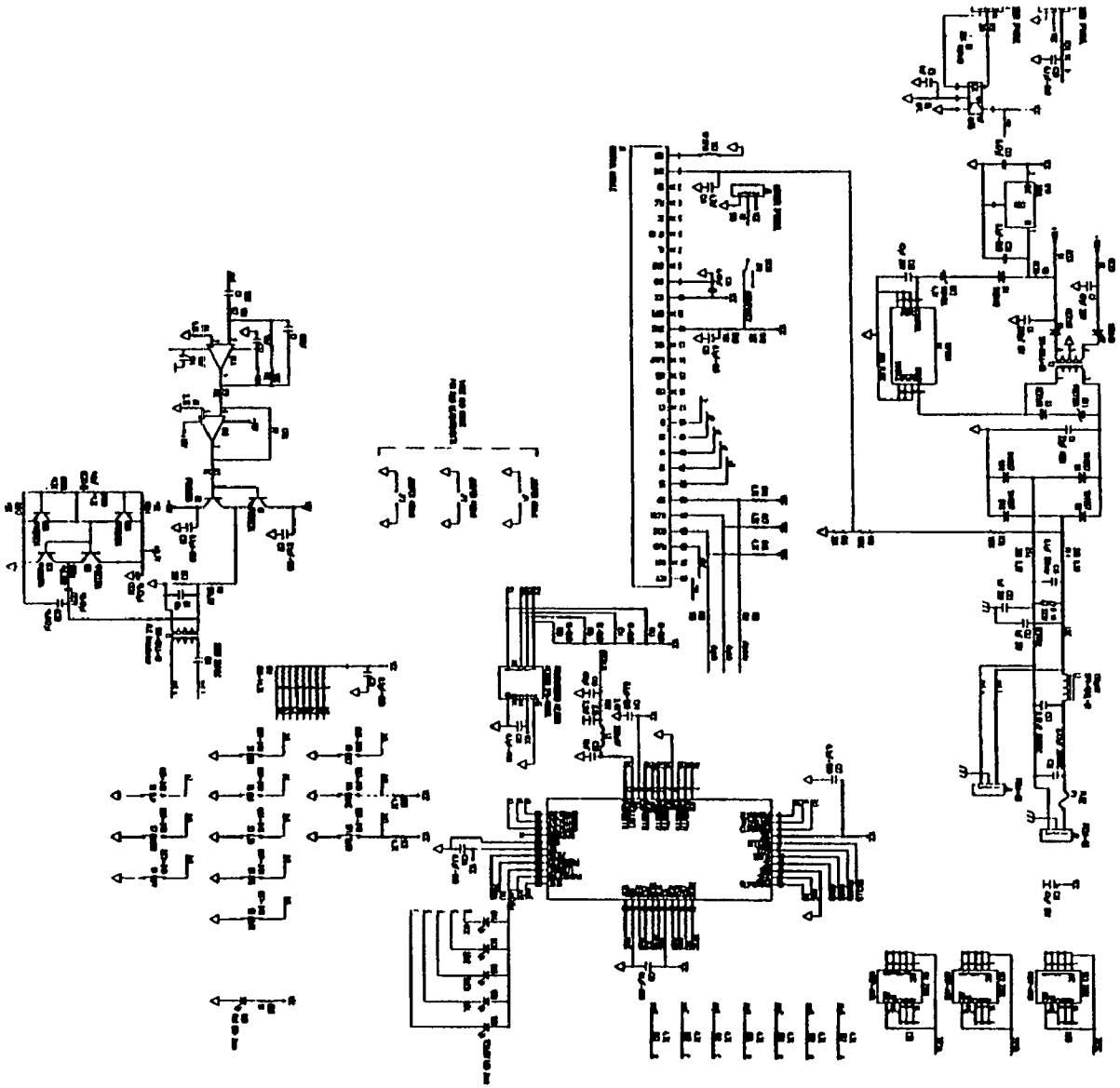
FIG. 23 is a Wall Control Unit schematic diagram for the diagram of FIG. 21.
Figure 24:
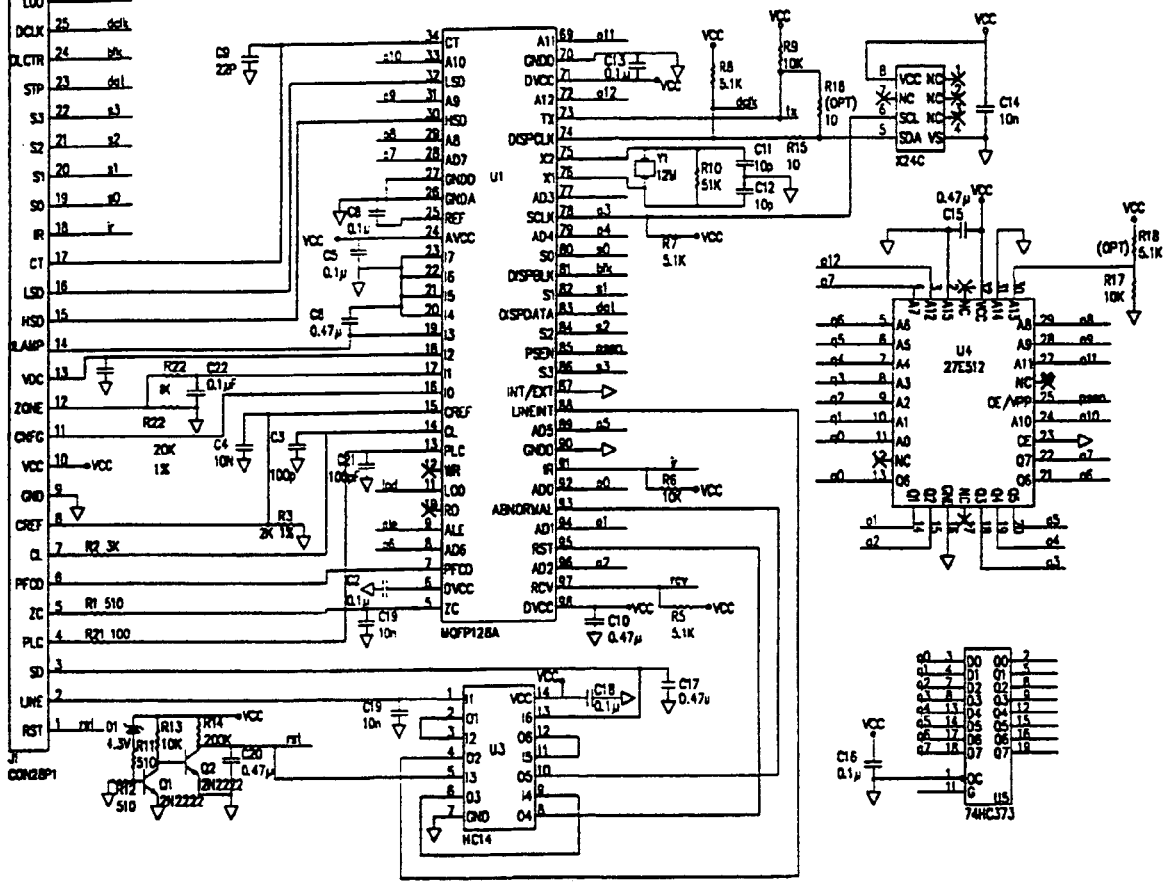
FIG. 24 is a further electrical diagram of the ballast control module of the invention.
Figure 25:
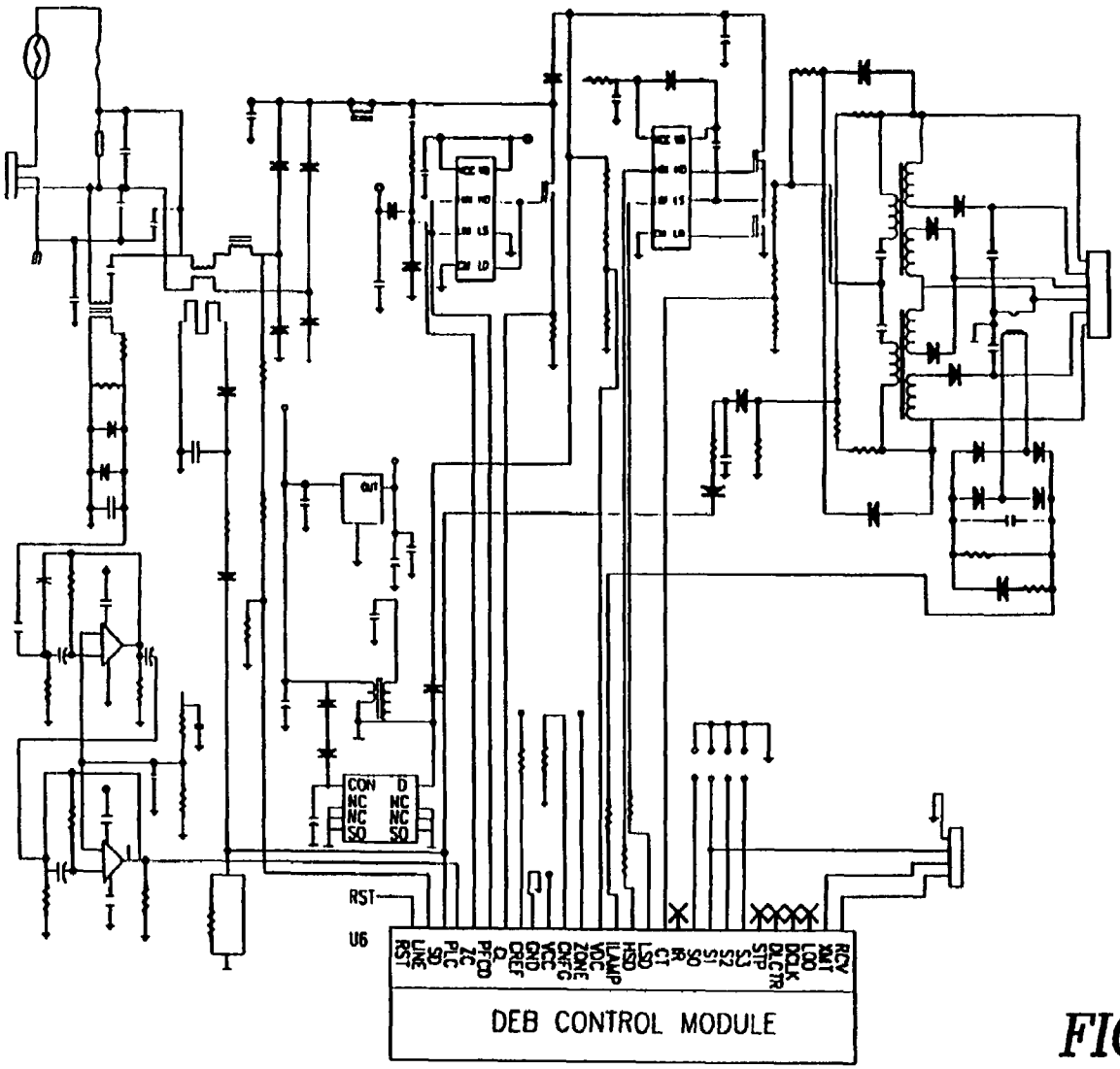
FIG. 25 is an electrical diagram of the ballast platform with control module.

The following describes various techniques employed in the novel digital approach to power management controllers, in particular to a dimmable electronic ballast. FIG. 21 shows the power line carrier (PLC) controlled dimmable ballast of layout similar to that shown in FIG. 16. The ballast control ASIC 200 is shown within the solid line block 200 in FIG. 20. PLC operation allows the ballast to receive dimming control information across the same power line being used to power the ballast. ASIC 200 is in turn schematically shown in FIG. 21A. The ASIC Pin assignments are shown in FIG. 22. The wall control unit (W.C.U.) schematics are also shown in FIG. 23. The techniques used in FIGS. 20, 21 and 22 are generally described as follows:

I. Feed Forward Dynamic Response Adaptation Based on Energy Consumption Prediction The dynamic response of the control loop is "flexible". It will use a different "dumping factor" & loop response time for a number of pre-decided conditions. For example the following decisions table is applied in the case of the electronic ballast:

If DC bus voltage is within the limits of Vref+−1% then "no response";

If DC bus is within the limits of +−3%>Vref>+−1% then "slow" response;

If DC bus is within the limits of +−10%>Vref>+−3% then "fast" response;

If step light level+if under 90% of desired then fast response;

If input voltage step changed more than +−2% then fast response, etc.

If a large change of the light is desired, the desired light level is first given to the controller, as for example, going from full light to light off (transient mode), then the PFC operation mode will be switched to fast response in order to avoid DC bus dips. At constant light (steady state) the PFC control switches to slow response mode preventing light flickering/glimmering.

Limits, dumping factors and response times are parameters listed in predefined designer programmable tables.

The control can be adjusted to handle all kinds of applications, including motor control, temperature control and many others.

II. Programmable Parameter Tables

Tables of parameters are programmed for all possible regimes of the needed application. For example, in the electronic ballast case there are about 12 different regimes for the Dimmable Electronic Ballast, including:

DC bus soft start;

Auxiliary build up;

Lamp preheat;

Lamp ignition;

Up going light level;

Down going light level;

Step up light level;

Step down light level;

Steady state "high" load;

Steady state "low" load;

Abnormals—output power shut-down; and

Input voltage switched off—or "black outs."

Every single regime has its own specific parameters table that is chosen when entering a new regime.

Each parameter table contains all the special parameters for PFC control and DC/AC bridge control for each specific regime. The designer can program these parameters.

In order to maintain a stable DC bus and the best PFC at all regimes, a digital control using programmable look-up tables gives the best "treatment" to each different regime (i.e. in the DC/AC bridge inverter control case the response time changes according to the lamp regimen operation).

With this approach, the more complicated the application, the more efficient the digital solution.

III. Adaptive Loop Parameters

Static and dynamic loop response adapt themselves to the inputs by getting feedback information from a number of digital and/or analog inputs chosen according to the right parameter tables, decision tables and addressed equations.

IV. Idle Periods Insertion to Change to Discontinuous Mode for Low Power Loads, Keeping Frequency Within Desired Limits As loads get smaller, frequency gets very high and "ON" pulses have to be very short in order to preserve critical mode conduction. Under a certain load, critical mode becomes impractical. At this point the control changes to "Discontinuous" mode and it stops controlling the "ON" time and begins controlling the "OFF" time of the pulse. The "ON time" is fixed to a desired "minimum usable pulse" (programmable parameter). "Off time" can change between none and "Discontinuous mode maximum dead time" (programmable parameter).

V. A Method for Controlling the Converter at No Load Conditions by Means of Implementing a Special "Stand By" PWM Regimen Mode Using Dedicated Programmable Parameters Table Special modes of operation can be "tailored" by using digital programmed control. All parameters, including: "pulse width", time between pulses, burst parameters and other parameters can be assigned for a specific task.

One example of this ability is the "stand by" mode which we use for the electronic ballast.

This mode is operational any time the ballast output stage is inhibited and the PFC stage must carry on its operation in standby mode. At this mode the PFC stage has two tasks: first—to provide the auxiliary voltages 5V and 12V to the control and second—to keep the DC bus voltage within limits.

When the PFC stage has very small load, the DC bus capacitor will charge rapidly to a nominal limit and will inhibit PFC control pulses. Special parameters are used in order to allow the PFC stage to provide auxiliary voltages: minimum pulse width and fixed dead time between pulses. Another mode of operation is to change from controlling the DC bus (except for maximum) to controlling the auxiliary voltage to 12V.

VI. Protection Method by Combining Multiple Parameter Levels Using Programmable Tables.

The parameter tables also contain some limits to provide part of the protections. For example: control pulses will be inhibited (pulse-by-pulse) in case of DC bus over-voltage (the pulses are inhibited if the DC bus is higher than 110%). Also, if input voltage is above a certain predetermined limit, pulses will be inhibited. Input under-voltage is also monitored; the PFC control will go to power shutdown mode under a predetermined limit (over-voltage protection (OVP) in the present ASIC implementation).

The PFC theory and parameters, are described as follows:

MinPFCParam

Max. PFC Ton pulse for Max load at Min Input RMS voltage
Ton = (255 − n)/12 MHz
100 1.29E−05 Sec MaxPFCParam Minimum usable Pulse for PFC control
125 4.17E−07 Sec LowDelPrs Discontinuous mode Maximum Dead time.
0 2.13E−05 Sec HighDelPrs At Critical mode only.
When getting ZC signal, waits 83 more nsec to activate PFC switch.
254 8.33E−08 Sec ShutHighDelPrs Fixed Dead time in Shut Down mode.
150 8.75E−06 Sec DampingFactor 1/Control Speed. control step = {[(Vref − VDC)/n] + 1} * 83 nsec
14

MaxVDC

Software ShutDown PFC Ton pulse will go off when VDC crosses this reference.
245 439.5 Volt VDCRef 2.19 Volt (A/D level) This is the normal VDC reference.
223 400 Volt VdcHys1

Range of steady state. At VDCRef +/− n PFC Ton pulse will not change.
2 3.6 Volt VdcHys1

Demand for fast response, fast PWM at VDC +− VdcHys1 or higher. When error is between VdcHys and VdcHys1, there will be a slow response. PWM = Fast
14 25.1 Volt PfcPWMPrs Slow PWM response factor.
20

PfcPWM1Prs

Fast PWM response factor (0 when no PWM).
0

MinPFCStartUp

Soft Start. Width of PFC Ton pulse when dc bus voltage climbs from zero to VDC.
253 1.67E−07 Sec -continued PFCTimerPRs "Slow" Loop response = 100 mSec. Every 10 msec, counter increased by 1.
10

PFCLoopCounterPRs

"Fast" Loop response = 1 mSec. Every 250 usec, counter increased by 1.
4

Sampling rate of VDC

Fixed at 500 usec.

Linkage between PFC and DC/AC: for step new light, PFC is "FAST" up to 90% of new light, and then becomes "SLOW" between 90% and 100% of new light. "90%" is not included as a parameter.

When changing the light by "UP" or "DOWN" PFC control is always "SLOW".

DcAc Parameters:

DcAcHys

Range for Fast/Slow response when Curr. Ref. is higher then 75. When Curr. Ref. is lower then 75, there is only slow response. Under 2 there is no change in Ton pulse.
2 is not included as a parameter.
5 1.96%

SlowDcAcPrs

Slow response PWM of 20 possible combinations of last and next Ton (HSD). Pulse may change every 250 usec.
20

FastDcAcPrs

Fast response PWM of 5 combinations. Pulse may change every 250 usec.
5

StartDcAcPrs

Response for DcAc StartUp (PWM) climbing to start up light after ignition.
15

HSD

Ton pulse changes always through all workline points.

StartTon

HSD Ton Pulse for lamp ignition.
175 6.67E−06 Sec

StartTonTime

Duration of HSD Ton Pulses for lamp.
ignition = 2 * 250 usec = 500 usec
2 500 uSec
Very fast Climbing to StartTon with NOPWM.

AbDelayPrs

Wait after shut down Shut Down period.
200 2 Sec

ShutTimerPrs

Wait after shut down Shut Down period.
200 2 Sec

EBCurrentRef

Lower Current reference for lower power dissipation on shunt resistor (EB).
51 1 Volt -continued LightLevel(6)

Table for IR Light decoding = n/2
"0, 2, 30, 80, 150, 200" "0, 1, 15, 40, 75, 100"%
LightBasePrs(4)

Fix points on lamp curve - 15, 40, 65, 100% Lamp current must be provided for each percentage point."
"30, 80, 130, 200" "15, 40, 75, 100"%
CurrentBase4

Volt 100% Light REFERENCE for ALL LIGHT LEVELS
227 2.23
MaximumLightLevel

Ballast Factor.
200 100%

Accessories Parameters:

MaxLightSensor

If n = 251 to 255 then occupancy switch closed.
250 2.45 Volt

-continued

MinStartDC

For DC control. If value is under 10(5%) then power shutdown
10 5%

PLC Parameters:

NoiseHys1

Digital filter for PLC after summation stage.
10
GlobalZone

0
TrxFreq(4)

PLC frequencies. F = 3ee06/(64 − n)
"33, 34, 35, 36" "96.77, 100, 103.44, 107.13" kHz The following is a lead assignment and function description for the ASICS of FIGS. 15 and 21 and the control module of FIG. 16:

| Pin | | | Electrical Data (VCC = 5 V) | | |
|---|---|---|---|---|---|
| No | Name | Function | Parameter | Value | Units |
| | | RESET, LINE SYNC, PROTECTION & P.L.C. PINS | | | |
| 1 | RST | Reset Schmidt Trigger Input<br>Reset Input of the Control Module, Control Module is in Reset state until Input reaches VIH level (2.2 X-3.5 V). Reset action is automatic. Reset Initialization Process is completed about 200 msec after Power on. | pull-up | 200 | KOhm |
| | | | Capacitance | 0.47 | uF |
| | | | Threshold | 2.2-3.5 | Volt |
| 2 | LINE | Line Phase Schmidt Trigger Input<br>Line Phase Input (see Ballast Platform Diagram for connection manner of LINE pin). | Positive Threshold | 2.2-3.5 | Volt |
| | | | Negative Threshold | 1-2.2 | Volt |
| | | | Frequency | 47-63 | Hz |
| 3 | SD | Shut-down Schmidt Trigger Input<br>Shut-down (Protection) Input for Abnormal Operation Protection. When voltage goes high, LSD&HSD immediately disables for 2 seconds. The controller tries to start the operation again at normal start-up routine. If Abnormal situation still exists it will shut-down again. After 10 attempts with 2 sec. intervals between attempts, Half Bridge Drive signals (HSD & LSD Outputs) are permanently inhibited (low level). If No Failure Operation lasts above 2 seconds, the Counter of 10 attempts resets (zero value). | Positive Threshold | 2.2-3.5 | Volt |
| | | | Negative Threshold | | Volt |
| | | | Min Pulse Width | | uSec |
| | | | Max Delay Time | | uSec |
| 4 | PLC | Power Line Carrier Comparator Input<br>Power Line Carrier (PLC) Remote Control data input. The following operations can be done via PLC Communication: Dimming, Ballast Turn on, Ballast Turn off & Zone Select. | Frequency Range | 95-105 | KHz |
| | | | Threshold | 1.67 | Volt |
| | | | pull-up | 100 | KOhm |
| | | PFC SECTION | | | |
| 5 | ZC | Zero Current Schmidt Trigger Input<br>Zero Current (ZC) pulse (High to low edge) Switch-On Time period. | Positive Threshold | 2.2-3.5 | Volt |
| | | | Negative Threshold | 1-2.2 | Volt |

-continued

| Pin | | | Electrical Data (VCC = 5 V) | | |
|---|---|---|---|---|---|
| No | Name | Function | Parameter | Value | Units |
| 6 | PFCD | PFC Drive Digital Output<br>PFC Drive signal Drives the PFC switch driver. | Min High | 4.5 | Volt |
| | | | Max Low | 0.3 | Volt |
| | | | Max Sink | 5 | mAmp |
| | | | Max Source | 5 | mAmp |
| 7 | CL | Current Limiter Comparator Input<br>Current Limiter Comparator limits (pulse-by-pulse) PFC Switch current by comparing PFC Switch Current Sample to 2.5 V. When pin voltage exceeds 2.5 V PFCD turns to low until the next PFC Cycle. | Threshold | 2.5 | Volt |
| | | | Pull-up | 100 | KOhm |
| 8 | REF | Current Reference Comparator Input<br>User Adjustable Current Reference Voltage compared to CL pin Voltage. Used to calibrate the PFC to minimum Input Line Current THD. | Max Ref. | 0.4 | Volt |
| | | | Min Ref. | 0.2 | Volt |
| | | | Pull-up | 100 | KOhm |
| | | POWER SUPPLY & REFERENCE SECTION | | | |
| 9 | GND | GND Power Supply Input<br>The GND of the 5 VDC supply is also reference for all Control Module signals | Max Current | 50 | mAmp |
| 10 | VCc | VCC Power Supply Input 5 VDC supply to the control module | VCCmax | 5.1 | Volt |
| | | | VCCmin | 4.9 | Volt |
| | | | Ivcc max | 44 | mAmp |
| | | A/D ANALOG INPUT SECTION | | | |
| General | | All Analog Inputs are connected to 8 bit A/D Converter via 4 inputs Analog Selector. The A/D Reference Voltage is 2.5 V. Input Voltage between 2.5 V to VCC converts to 255 Digital Value. The Digital Converted Value is: $\#D = 255*V_{ANALOG}/2.5$ (Integer 8 bits) | | | |
| 11 | CNFG | Ballast Configuration Analog Input<br>Analog input is used to define 5 Ballast Configurations by different Voltage Level Limits. See Configuration Table 1 for details. CNFG Voltage is sampled during Reset Initialization Process to determine Ballast Configuration. CNFG Pin is ignored during Ballast operation after the initialization. | DC Range | 0-0.24 | Volt |
| | | | Occupancy | 0.25-0.73 | Volt |
| | | | PLC Range | 0.74-1.22 | Volt |
| | | | Local Range | 1.23-1.71 | Volt |
| | | | E.B. Range | 1.72.2.5-1.71 | Volt |
| | | | Pull-up | 100 | KOhm |
| 12 | ZONE | Zone Select/Analog Input<br>Analog input used:<br>1) to define 8 Ballast Zone at PLC Configuration, by different voltage Level Limits. See Zone identification Table 2 and PLC D.E.B section for detail | Zone Range Width | 0.25 | Volt |
| | | | All Zone | 0-0.25 | Volt |
| | | | Zone 1 Range | 0.25-0.5 | Volt |
| | | | Zone 7 Range | 1.75-5 | Volt |
| | | 2) to determine Light Level at DC configuration, by voltage Level See DC D.E.B. section for details | Max Light | 2.22 | Volt |
| | | | Zero Light | Parameter | digital |
| | | 3) as Light Sensor Analog Feedback Input at Local Configuration. See LOCAL D>E>B> section for details | Max Level | 2.2 | Volt |
| | | | Min Level | 0.2 | Volt |
| | | 4) to determine Low Light Level at Occupancy Configuration, by voltage Level. The % Light Level is determined according to formula:<br>$\% \text{ Light} = (V_{ZONE}\ 2.23) \times 100$<br>At Occupancy, ZONE pin is sampled at transit from normal light to (non) occupancy. See Occupancy D.E.B. section for details | | | |
| 13 | VDC | PFC stage, output DC bus voltage Analog Feedback Input<br>Analog Feedback input for PFC output DC bus voltage. This voltage is Software Compared to 2.23 VDC (the Converted Value Compared to #227) predefined reference, to provide the DC/AC stage with | 0% Light | Customer determines the expected ILAMP | |

-continued

| Pin | | | Electrical Data (VCC = 5 V) | | |
|---|---|---|---|---|---|
| No | Name | Function | Parameter | Value | Units |
| | | the required DC voltage. (The Feedback Loop stabilizes the VDC Pin to 2.23 VDC.) | | Voltage for each of these 4 fixed points (By PDK Software) | |
| | | | 15% Light | | |
| | | | 40% Light | | |
| | | | 65% Light | | |
| | | | 100% Light | 2.23 | Volt |
| | | DC/AC SECTION | | | |
| 15 | HSD | High Side Switch Driver Signal Digital Output | | | |
| | | 5 V Pulse Modulated Drive Signal to High Side switch of the DC/AC Driver | Max Current | 5 | mAmp |
| | | | Min High | 4.5 | Volt |
| | | | Max Low | 0.3 | Volt |
| 16 | LSD | Low Side Switch Driver signal Digital Output | Max Current | 5 | mAmp |
| | | 5 V Pulse Modulated Drive Signal to Low Side switch of the DC/AC Driver | Min High | 4.5 | Volt |
| | | | Max Low | 0.3 | Volt |
| 17 | CT | Center Tap Voltage sample Schmidt Trigger Input | | | |
| | | The Center Tap voltage sample from Half Bridge center tap is used to keep Half Bridge at Zero Voltage Switching mode and to match the HSD & LSD timing to keep the Half Bridge Load's inductive character. | Positive Threshold | 2.2-3.5 | Volt |
| | | | Negative Threshold | 1-2.2 | Volt |
| | | DIGITAL INPUTS | | | |
| | | All Digital Inputs, except IR, are sampled during Reset Initialization Process and ignored during Ballast operation after the Initialization | | | |
| | | The following data is related to all Digital Inputs. Pull-up is semiconductor type | Min High | 2.4 | Volt |
| | | | Max Low | 0.8 | Volt |
| 18 | IR | Infrared Control Digital Input | | | |
| | | Infrared Control Digital input signal used to control Light Level y Digital Code in LOCAL configuration only. | Pull-up | 7.5 to 8 | KOhm |
| | | SO-S3: Parameters Tables Select Digital Inputs | | | |
| 19 | SO | Desired Parameters Table is selected by 4 bit hexadecimal. | Pull-up | 30 to 40 | KOhm |
| | | Code 0-12 selects one of 13 Internal Predefined Parameter Tables. | | | |
| | | Code 13 selects EEPROM Parameter Table. | | | |
| | | Code 15 selects Programming Mode of EEPROM Parameters Table. | | | |
| | | Code 14 is not applicable | | | |
| 20 | S1 | | | | |
| 21 | S2 | | | | |
| 22 | S3 | | | | |
| 23 | STP | Step-by-Step operation Digital Input. | | | |
| | | Input enables Step by Step operation of the Ballast. | Pull-up | 30 to 40 | KOhm |
| | | Digital "low" activates Step by Step operation mode. | | | |
| | | Momentary Digital "high" forwards to the next step. | | | |
| | | Step 0 (Reset): Before any Digital "high" pulse to STP Pin. No Drive pulses from PFCD, HSD & LSD pins. | | | |
| | | Step 1: Operates PFC stage operation only | | | |
| | | Step 2: Operates Lamp Preheat | | | |
| | | Step 3: Lamp Ignition & Steady State Operation | | | |
| 24 | DLCTR | Inhibits Center Tap Protection. Digital Active Low Input | | | |
| | | Digital "Low" to DLCTR Pin Inhibits Center Tap Protection | Pull-up | 30 to 40 | KOhm |
| | | Facility for Ballast development only. (Refer to PDK Manual) | | | |
| 25 | NOT APPLICABLE | | | | |
| 26 | LOD | Local Oscillator Driver Digital Output | | | |
| | | Local Oscillator Driver 46.9 KHz fixed frequency digital square wave is available immediately after Reset. | Max Current | 5 | mAmp |
| | | | Min High | 4.5 | Volt |
| | | | Max Low | 0.3 | Volt |
| | | | Duty Cycle | 0.5 | |
| | | | Frequency | 46.9 | KHz |

-continued

| Pin | | | Electrical Data (VCC = 5 V) | | |
|---|---|---|---|---|---|
| No | Name | Function | Parameter | Value | Units |
| 27 | TX | Parameters Programming Transmitter Digital Output TX Pin is used as a transmitting output for RS232 Communication using Parameters Development Kit (PDK, SI/PDK-02) during Programming Mode. | Min High | 4.5 | Volt |
| | | | Max Low | 0.3 | Volt |
| | | | Max Sink | 1 | mAmp |
| | | | Max Source | 1 | mAmp |
| 28 | RCV | Parameters Programming Receiver Digital Input RCV Pin is used as Receiving input for RS232 Communication using Parameters Development Kit (PDK, SI/PDK-02) during Programming Mode. RCV Pin is also used as Occupancy signal input at Occupancy and Local configurations. (see Local D.E.B. and Occupancy D.E.B. sections for details) | Min High | 2.4 | Volt |
| | | | Max Low | 0.8 | Volt |
| | | | Pull-up | 30 to 40 | KOhm |

The following is a description of operating voltages and the like for the ASIC 200 and Control Module:

MAXIMUM RATINGS

| Units | Max | Min | Parameter Definition | Symbol |
|---|---|---|---|---|
| V | 5.5 | −0.5 | DC Supply Voltage (Referenced to GND) | VCC |
| mAmp | 50 | | DC Supply Current. VCC & GND pins | ICC |
| V | vCC + 0.5 | −0.5 | Pick Inputs Voltage, Referenced to GND (RST, LINE, SD, PLC, ZC, CL, CREF, CNFG, ZONE, VDC ILAMP, CT, IR, S0, S1, S2, S3, STP, DLCTR, RCV.) | Vout |
| V | VCC + 1 | −1 | Pick outputs Voltage Referenced to GND (PFCD, HSD, LSD, DCLK, PLCD, XMT.) | Iout |
| mAmp | +5 | −5 | Pick outputs Current (PFCD, HSD, LSD, PLCD) | Iout1 |
| mAmp | +1 | −1 | Pick outputs Current (DCLK. XMT) | Iout2 |
| mW | 275 | | Power Dissipation | PD |

-continued

MAXIMUM RATINGS

| Units | Max | Min | Parameter Definition | Symbol |
|---|---|---|---|---|
| ° C. | +150 | −55 | Storage Temperature | Tstg |
| ° C. | 260 | | Lead Temperature | TL |

RECOMMENDED OPERATION CONDITIONS

| Symbol | Parameter | Min | Max | Unit |
|---|---|---|---|---|
| VCC | DC Supply Voltage (Referenced to GND) | 4.9 | 5.1 | V |
| ICC | DC Supply current, VCC & GND pins | 36 | 44 | mAmp |
| Vin (A) | Analog Inputs Voltage (CNFG. ZONE. VDC. VLAMP) | 0 | 2.5 | V |
| Vin (D) | Digital Inputs Voltage (All other inputs) | 0 | VCC | V |
| Vout | Output Voltages (PFCD, HSD, LSD, DCLK, PLCD, XMT.) | 0 | VCC | V |
| TAMB | Ambient Temperature | 0 | 70 | ° C. |

ELECTRICAL CHARACTERISTICS

VCC = 5 V unless Test Conditions are different

| Pin | | | | Parameter | | | | | | |
|---|---|---|---|---|---|---|---|---|---|---|
| Sec. | Type | Name | No. | Symbol | Definition | Min | Typ | Max | Units | Test Conditions |
| | | | | | Power Supply | | | | | |
| | Power Supply | VCC | 10 | UVLO | Under-voltage Lock Out voltage | 4.3 | 4.5 | 4.7 | V | Vcc Applied, Vcc Disabled |
| | | | | ICC | Supply current | 39 | 43 | 47 | mA | |
| | | | | | Reset | | | | | |
| | Digital Input | RST | 1 | VRST | Pin voltage at steady state | 4.5 | 4.9 | 5 | V | |

-continued

ELECTRICAL CHARACTERISTICS

VCC = 5 V unless Test Conditions are different

| Sec. | Type | Pin Name | Pin No. | Symbol | Definition | Min | Typ | Max | Units | Test Conditions |
|---|---|---|---|---|---|---|---|---|---|---|
| | | | | TRST1 | Hard Reset Time (4) | 65 | 100 | 150 | mSec | |
| | | | | TRST2 | Total Reset Time (5) | 165 | 200 | 250 | mSec | |
| | | | | | Interrupt | | | | | |
| | Schmidt Trigger Input | LINE | 2 | VIH | Positive going Input Threshold | 2.5 | | 3.5 | V | |
| | | | | VIL | Negative going Input Threshold | 1 | | 2.2 | V | |
| | | | | FLINE | Operational Frequency | 47 | 50/60 | 63 | Hz | |
| | | | | | Protection | | | | | |
| | Schmidt Trigger Input | SD | 3 | VIH | Positive going Input Threshold | 2.5 | 2.7 | 3.5 | V | |
| | | | | VIL | Negative going Input Threshold | 1 | | 2.2 | V | |
| | | | | SDPW | Minimum Pulse Width to activate SD protection | | | | uSec | |
| | | | | | PLC Communication | | | | | |
| | Comparator Input with 100k Pull-Up | PLC | 4 | VPLC | Voltage at PLC input | 4 | | 5 | V | Open input |
| | | | | PLC REF | Comparator Internal Reference Voltage | | 1.67 | | V | Vcc = 5.0 V |
| | | | | | PFC | | | | | |
| | Schmidt Trigger Input | ZC | 5 | VIH | Positive going Input Threshold | 2.5 | | 3.5 | V | |
| | | | | VIL | Negative going Input Threshold | 1 | | 2.2 | V | |
| | Digital Output | PFCD | 6 | VOH | High level voltage of PFC pulse | 4.5 | 4.9 | 5 | V | 10 pF load |
| | | | | VOL | Low level voltage of PFC pulse | −0.3 | 0 | 0.3 | V | 10 pF load |
| | | | | IO | Output Current Sink & Source | | 5 | | mA | |
| | | | | TonMax | Maximum applicable PFC Ton Pulse-Width | | 12.9(1) | 66(2) | uSec | |
| | | | | TonMin | Minimum applicable PFC Ton Pulse-Width | | 0.42 | | uSec | |
| | | | | ToffMax | Maximum applicable PCF Dead time (Discontinuous mode) | | 21.3(1) | 66(2) | uSec | |
| | Comparator Input with 100k Pull-Up | CL | 7 | CLREF | Current Limit Comparator Internal Reference Voltage | | 2.5 | | V | |
| | Comparator Input with 100k Pull-Up | CREF | 8 | VCREF | Voltage at comparator input (Fine Tuning of Minimum THD) | 0.2 | | 0.4 | V | Adjusted by user |
| | | | | | A/D Analog Inputs Section | | | | | |
| | Analog Input | CNFG | 11 | Vopen | Open Analog Input Voltage (Analog Input with Internal 100k Pull-Up) | 4.5 | 4.9 | 5 | V | open input |
| | Analog Input | ZONE | 12 | Voper | Operation Analog Input | 0 | | 2.5 | V | set by voltage divider |
| | Analog Input | VDC | 13 | | | | | | | |
| | Analog Input | ILAMP | 14 | | | | | | | |
| | | | | | DC to AC Section | | | | | |
| | Digital Output | HSD | 15 | VHSD | High level value of HSD output | 4.5 | | 5 | V | 10 pF load |
| | | | | TonMax | High limit of HSD Ton Pulse Width | 0.37 | | 20.4 | uSec | (3) |
| | | | | TonMin | High limit of HSD Ton Pulse Width | 0.37 | | 20.4 | uSec | (3) |
| | | | | TonWU | Ton Pulse Width | 0.37 | | 20.4 | uSec | (3) |
| | | | | TonIGN | Ton Pulse Width | 0.37 | | 20.4 | uSec | (3) |

-continued

ELECTRICAL CHARACTERISTICS

VCC = 5 V unless Test Conditions are different

| Sec. | Type | Pin Name | Pin No. | Symbol | Definition | Min | Typ | Max | Units | Test Conditions |
|---|---|---|---|---|---|---|---|---|---|---|
| | Digital Output | LSD | 16 | VLSD | High level value of LSD output | 4.5 | | 5 | V | 10 pF load |
| | | | | LSDTon | Ton Pulse Width | 0.37 | | 20.4 | uSec | (3) |
| | Schmidt Trigger Input | CT | 17 | VIH | Positive going Input Threshold | 2.5 | | 3.5 | V | |
| | | | | VIL | Negative going Input Threshold | 1 | | 2.2 | V | |
| | | | | | Digital Inputs | | | | | |
| | Digital Input With Internal 7.5K Pull-Up | IR | 18 | VIRO | Voltage at IR Open Input | 4.8 | 4.98 | 5 | V | open input |
| | Digital Input | SO | 19 | VDIO | Voltage at Digital Open Input | 4.5 | 4.98 | 5 | V | open input |
| | With Internal 30K to 40K Pull-Up | S1 | 20 | | | | | | | |
| | | S2 | 21 | | | | | | | |
| | | S3 | 22 | | | | | | | |
| | | STP | 23 | | | | | | | |
| | | DLCTR | 24 | | | | | | | |
| | | | | | Local Oscillator/Output Driver | | | | | |
| | Digital Output | LOD | 26 | FLOD | Frequency of LOD output | | 46.9 | | KHz | |
| | | | | VLOD | Amplitude of LOD output | 4.5 | 5 | 5 | V | 10 pF load |
| | | | | | Serial Communication Section | | | | | |
| | Digital Output 7.5K Pull-Up | XMT | 27 | VXMT | Amplitude Voltage of XMT output | 4.5 | 4.98 | 5 | V | 10 pF load |
| | Digital Input 5K Pull-Up | RCV | 28 | VRCV | Voltage at RCV open input | 4.5 | 4.98 | 5 | V | open input |

Notes:
(1)Numbers are subject to Customization
(2)Reaching its maximum value at Line Zero Cross, under Max Load and minimum input Line RMS voltage
(3) EEPROM Programmable Parameters. E1 Char.do
(4) C20 (See CONT_B.Sch) Charge Time to Schmidt Trigger Input Positive going Input Threshold (VIH).
(5) C20 Charge Time + Software Delay Time The following is an operation description which describes control module 111 and ASIC 200 settings:

Customer Selectable Parameters for D.E.B. Applications

The customer can influence ballast behavior by determining several ballast parameters. Software is used to determine the ballast parameters. The customer parameters below describe these parameters.

Customer Parameters Table

| No. | Parameter Name | Parameter Description | Possible Range | Rational Range | Units |
|---|---|---|---|---|---|
| | | Frequency Parameters | | | |
| 1 | Low Switch Ton | Required LSD Pulse Width | | | |
| 2 | Minimum High Switch Ton | Required Minimum HSD Pulse Width | | | |
| 3 | Maximum High Switch Ton | Required Maximum HSD Pulse Width | | | |

-continued

Customer Parameters Table

| No. | Parameter Name | Parameter Description | Possible Range | Rational Range | Units |
|---|---|---|---|---|---|
| | | Lamp Curve Parameters | | | |
| 4 | Minimum Light | Expected Minimum Lamp Current Sense Voltage VILAMP(mim | | | |
| 5 | 15% Light | Expected 15% Lamp Current Sense Voltage VILAMP (15%) | | | |
| 6 | 40% Light | Expected 15% Lamp Current Sense Voltage VILAMP (40%) | | | |
| 7 | 65% Light | Expected 15% Lamp Current Sense Voltage VILAMP (65%) | | | |
| | | Warm-up Parameters | | | |
| 8 | Warm-up High Switch Ton | Required Warm-up HSD Pulse Width | | | |
| 9 | Time | Required Warm-up Time | | | |
| | | Light Parameters | | | |
| 10 | Minimum Light | Required Minimum % Light Level | | | |
| 11 | Start Up Light | Re | | | |
| | | Ignition Parameters | | | |
| 12 | Ignition High Switch Ton | Required Ignition HSD Pulse Width | 0.37-20.37 | 2-13 | |
| 13 | Ignition Time | Required Ignition Time | 0-25 | 0-25 | mSec |
| 14 | Post Ignition High Switch Ton | Required Post Ignition HSD Pulse Width | 0.37-20.37 | 1-13 | |

Parameters Tables Selection

The control module 111 contains 13 parameters tables in its PROM and one customer parameters table in its EEPROM. Only the manufacture can change the parameters of tables 0-12. The customer can program its own parameters in EEPROM Table 13 using a Parameter Development Kit (PDK).

Tables 0-3: Versions for two T8-32W (parallel configuration) lamps (120V line application). Tables 4-12: Versions for two T8-36W (parallel configuration) lamps (230V line application).

Of course, customization of internal parameter tables is possible. A desired parameter table is selected by combination of micro-jumpers S0, S1, S2, S3 (connected to S0-S3 pins) to create a hexadecimal number. Insert jumper for a logic "0", and leave open for logic "1". The Parameter Tables Selection Table below defines the selection of the desired parameters table.

Parameters Tables Selection Table

| Table | S0 | S1 | S2 | S3 | Function |
|---|---|---|---|---|---|
| 0 | 0 | 0 | 0 | 0 | Select parameters from one of 13 Pre-Defined Tables in the PROM |
| 1 | 1 | 0 | 0 | 0 | |
| 2 | 0 | 1 | 0 | 0 | |
| 3 | 1 | 1 | 0 | 0 | |
| 4 | 0 | 0 | 1 | 0 | |
| 5 | 1 | 0 | 1 | 0 | |
| 6 | 0 | 1 | 1 | 0 | |
| 7 | 1 | 1 | 1 | 0 | |

-continued

Parameters Tables Selection Table

| Table | S0 | S1 | S2 | S3 | Function |
|---|---|---|---|---|---|
| 8 | 0 | 0 | 0 | 1 | |
| 9 | 1 | 0 | 0 | 1 | |
| 10 | 0 | 1 | 0 | 1 | |
| 11 | 1 | 1 | 0 | 1 | |
| 12 | 0 | 0 | 1 | 1 | |
| 13 | 1 | 0 | 1 | 1 | Select parameters from EEPROM Parameters Table |
| 14 | 0 | 1 | 1 | 1 | Reserved for Internal Use |
| 15 | 1 | 1 | 1 | 1 | PDK Programming mode. Disable Ballast Operation and enable EEPROM Parameters Table Programming by PDK. |

Selected Ballast Configuration Options: Selected via A/D Input CNFG

Control module 111 and ASIC 200 enable ballast operation in 5 different configurations as follows:

| | |
|---|---|
| PLC D.E.B. | Ballast is remote controlled from Wall Control Unit with Power Line Carrier (PLC) interface. In PLC configuration, the ballast can be designated as belonging to one of 7 different zones or as belonging to all zones. Ballast zone designation is selected via A/D input ZONE. (See PLC D.E.B. Section below). |

-continued

| | |
|---|---|
| DC D.E.B. | Ballast is controlled from DC Wall Control Unit via DC lines. (See LOCAL D.E.B. Section below). |
| LOCAL D.E.B. | Ballast is controlled from local infrared IR light & occupancy sensors. (See LOCAL D.E.B. Section below). |
| Occupancy D.E.B. | Ballast is controlled from local occupancy sensor. (See occupancy D.E.B. Section below). |
| E.B. | Non Dimmable Electronic Ballast. (See E.B. Section). |

The Ballast Configuration Table shows ballast configuration selection via the CNFG pin. To get the required configuration, connect a resistor between CNFG pin and GND.

Ballast Configuration Table

| Configuration | PLC | DC | Occupancy | Local | E.B. |
|---|---|---|---|---|---|
| CNFG Voltage Range | 0.73-1.22 | 0-0.24 | 0.25-0.73 | 1.23-1.71 | 1.71-2.5 |
| Converted Digital Value | 75-125 | 0-25 | 25-75 | 125-175 | 175-255 |
| Recommended Resistor (5%) | 30 KΩ | 0 Ω | 13 KΩ | 51 KΩ | 130 KΩ |

PLC D.E.S.

Start Up

The ballast starts lamps at "last light level" (saved on the EEPROM). The light level stays in Last Light Level until a dimming command is sent from the wall Control Unit via PLC communication.

PLC Function

The ballast receives a 17-bit string from the Wall Control Unit (W.C.U.) via PLC Remote Controlled Communication. Bit allocation is as follows:

| | |
|---|---|
| 1 bit | Start |
| 2 bits | Control operation modes |
| 3 bits | 7 Selected zones |
| 6 bits | 64 light level |
| 4 bits | Check Sum |
| 1 bit | Spare |

The rate of communication is 1 bit per line cycle. PLC communication is synchronized to the line phase.

Ballast Zone Identification

Designation of the ballast zone identity (0-7) is implemented by providing a voltage in equal equidistant increments between 0 to 2.5V to the zone pin. The Zone Selection Table is shown below.

Zone Selection Table

| Zone | All Zone | 1 | 2 | 3 | 4 | 5 | 6 | 7 |
|---|---|---|---|---|---|---|---|---|
| Center Voltage | 0.125 | 0.375 | 0.625 | 0.875 | 1.125 | 1.375 | 1.625 | 1.875 |
| Voltage Range | 0-0.25 | 0.25-0.5 | 0.5-0.75 | 0.75-1 | 1-1.25 | 1.25-1.5 | 1.5-1.75 | 1.75-2 |

EEPROM Function

When "Line Disappeared" is detected, (via the line pin) the present light is saved as "last light level" in the EEPROM. When the ballast is switched on it will revert to this "last light level". When "Table 15" (S0, S1, S2, S3="1") is selected, the EEPROM can be programmed to a desired parameters table. When Table 13 is selected, the parameters table is obtained from the EEPROM.

DC D.E.B.

Start Up

The ballast starts the lamps according to the last light level from the EEPROM parameters table and then increases or decreases to the DC controlled light level present in the ZONE pin. This DC level is applied from the DC control unit. The light level is related to ZONE pin voltage according to the following formula:

$$\text{Light Level}=(\text{ZONE pin Voltage}/2.23\text{V})\times\text{Maximum Light Level}$$

The maximum light level is obtained when the ZONE pin voltage is 2.23V (converted to 227).

The lamp light goes to 0 when the ZONE pin voltage drops under 110 mV. The Ballast starts-up when ZONE pin voltage exceeds 140 mV.

LOCAL D.E.B.

Start Up

The ballast will start the lamps according to the last light level saved in the EEPROM parameters table.

Local IR Function

The IR receiver output signal is connected to the IR pin.

The IR transmitter sends 8 codes: 5 Preset light levels, Up, Down and Off commands.

Light Sensor Function

The ballast light level is controlled by a light sensor connected via the ZONE pin. The ZONE pin is feedback input converted to a digital number and compared to the sensor reference value.

The Sensor Reference value is set to the light sensor (ZONE pin) value during reset initialization. In the case of constant voltage at the ZONE pin (open loop), the light level stays at the last light level (no error detected—Sensor Reference=ZONE pin voltage, and no dimming UP or DOWN command is generated).

The dimming command from the IR transmitter changes the sensor reference and changes the light level by a controlled close loop mechanism to get:

Light Sensor=New Sensor Reference.

Light Sensor voltage range is 0.2V to 2.45V.

Occupancy Function (at Local Configuration)

Two inputs serve the occupancy function:

The "Occupancy OFF" command uses the RCV pin. Logic "1" (open circuit) at the RCV pin detected as a "No Presence" and turns the ballast off. Logic "0" at the RCV pin is detected as "presence" and starts-up the ballast to last light value.

The ZONE analog input pin is also used as a "No Presence Inhibit". If ZONE pin Voltage>2.5V then "No Presence" disabled. The ballast dims the light to the minimum light level.

After the occupancy sensor detects a presence in the room, the ballast returns to the last light level. There is no delay time between "No Presence" detection (by the control module) and the dimming operation.

Occupancy D.E.B.

Start Up

Ballast will start lamps according to last light level saved in the EEPROM parameters table.

Occupancy Function

The RCV pin series as a "Presence Detection" input. When "No Presence" detected (logic "High"-open circuit) at the RCV pins he ballast dims the light to the defined "Dim Light Level" on the ZONE pin. The dim light level is saved a the "No Presence Detected" moment according to following formula:

Dim Light Level=[Maximum Light Level]×[ZONE Voltage at Initialization Time]2.23V.

The ballast returns to the maximum light level after occupancy sensor detects a presence in the room (logic "0" at ZONE pin).

Note: There is no delay time between "No Presence" detection (by Control Module) and the dimming operation.

EB

Start Up

Ballast will start lamps to "Maximum Light Level".

E.B. Function

The ballast operates only at the maximum light level. Dimming is not possible. As in all other configurations, the lamp current is stabilized by closed loop control via the ILAMP feedback input pin. The ILAMP pin voltage is 0.5V at the maximum light level situation.

Housekeeping/Protection Circuits

Four input pins of the control module 111 and ASIC 200 are used for the protection functions of the ballast.

The CL input is used for current limit protection of PFC switch. The PFCD output in (PFC Drive Pulse Signal) is pulse-by-pulse inhibited when the CL input exceeds 2.5V.

The VDC A/D input pin is used for closing the DC bus (PFC Output) loop and also as a hardware over-voltage protection sense input. (Input to analog comparator). The PFCD output is pulse-by-pulse inhibited when the VDC pin voltage exceeds 2.5V. Also, the VDC input is used for software over-voltage protection. Alternatively, the PFCD output is pulse-by-pulse inhibited (by software) when the VDC pin voltage exceeds 2.4V.

The CT input is used to keep the half bridge at a zero voltage switching (ZVS) operation. If the load becomes capacitive, the CT input will partially block the HSD or LSD outputs (increase dead times in order to keep ZVS operation). If the limitation causes total disappearance of HSD pulses 16 times, then 4 cycles are enabled without interfering with the CT input. This total cycle of 20 (16+4) will repeat itself 16 times and if the malfunction does not disappear, it will activate the abnormal function.

The SD input is used to sense catastrophic failures of the ballast. When the SD input exceeds the Schmidt Trigger positive going threshold (2.2V-3.5V) according to catastrophic ballast failure occurrence, then hardware immediately inhibits (shuts down) the HSD & LSD outputs and software activates the abnormal function. The controller will try to start-up the ballast again 2 seconds after shutdown. If no abnormal indication is detected 2 seconds after ignition of the lamps, the abnormal protection procedure automatically resets an internal failure counter. If the failure is still detected, the controller will try to start-up the ballast 10 times with 3 second intervals between attempts. After 10 tries, the HSD & LSD outputs will be permanently inhibited. CT protection is also monitored as a catastrophic failure.

An abnormal condition of CT protection initiates the same abnormal protection procedure.

What is claimed is:

1. An electronic power controller for a gas discharge device, said power controller comprising:

an input circuit adapted to provide input a-c power;

an a-c filter connected to said input circuit;

a rectifier bridge connected to said input circuit for producing an output d-c voltage from said a-c input power;

an inverter circuit including a high side switch and a low side switch connected in series at a node and connected across the output of said inverter circuit;

a load circuit connected to said node and including said gas discharge device;

said high side and low side switches each having input control terminals energizable to turn them on and off and each having a parallel diode;

a master control circuit for applying suitably timed control signals for alternately turning said high side and low side switches on and off; and a dynamic dead time control circuit in said master control circuit for insuring only a short interval between the end of current conduction by either said high side and low side devices and the beginning of conduction by the other by the control of the application of controls signals to their control terminals;

said dynamic dead time control circuit being coupled to and monitoring at least one of the current in said resonant load, the current in said first and second switches, the output voltage of said rectifier bridge or the rate of change dv/dt of said bridge voltages and adjusting the application of turn on signals to said high side and low side switches for both capacitive and inductive operations.

2. An electronic power controller according to claim 1, which further includes a PFC stage coupled between said rectifier bridge and said inverter.

3. An electronic power controller according to claim 1, wherein:

said gas discharge device has first and second filaments; and said resonant coupling circuit includes:

an inductor and a capacitor connected in series with said first and second filaments;

first and second windings coupled to said inductor; and first and second diodes connected in series with said first and second windings respectively and said first and second diodes respectively, whereby the disconnection of said device and said filaments from its fixture opens the output circuit from said inverter circuit.

4. An electronic power controller according to claim 1, wherein said a-c filter includes a common mode inductor.

5. An electronic power controller according to claim 4, which further includes:

a monitor circuit coupled to said common mode inductor for sensing a high frequency ground fault current at a frequency greater than the frequency of said input a-c power to a ground connection; and a controller circuit coupled to said monitor circuit to turn off the power to said inverter circuit when said high frequency ground current exceeds a preset value.

6. An electronic power controller according to claim 5, wherein:

said gas discharge device has first and second filaments;

said resonant coupling circuit includes:

an inductor and a capacitor connected in series with said first and second filaments;

first and second windings coupled to said inductor;

first and second diodes connected in series with said first and second windings respectively and said first and second diodes respectively, whereby the disconnection of said device and said filaments from its fixture opens the output circuit from said inverter circuit.

7. An electronic power controller according to claim 5, wherein:

said power controller operates at least two gas discharge units connected in parallel in a fixture, said gas discharge units each have first and second filaments;

said resonant coupling circuit includes:

an inductor and a capacitor connected in series with said first and second filaments;

first and second windings coupled to said inductor;

first and second diodes connected in series with said first and second windings respectively and said first and second diodes respectively, whereby the disconnection of all of said devices and said filaments from the fixture opens the output circuit from said inverter circuit.

8. The device of claim 1, wherein said dynamic dead time control circuit comprises:

a current transformer in series with said resonant load circuit to measure the current therethrough;

and a comparator circuit operative to compare the output of said current transformer to a reference value to generate a dead time interval having a small value.

9. The device of claim 1, wherein said dynamic dead time control circuit comprises:

current transformer connected to said node which is operative to monitor the voltage at said node;

and a comparator circuit operative to compare the output of said current transformer to a reference value to generate a dead time interval having a small value.

10. The device of claim 1, wherein said dynamic dead time control circuit comprises:

a dv/dt circuit coupled to said node operative to monitor the dv/dt at said node; and a comparator circuit operative to compare the output of said current transformer to a reference value to generate a dead time interval having a small value.

11. An electronic power controller according to claim 1, wherein:

said power controller operates at least two gas discharge units connected in parallel in a fixture, said gas discharge units each have first and second filaments;

said resonant coupling circuit includes:

an inductor and a capacitor connected in series with said first and second filaments;

first and second windings coupled to said inductor;

first and second diodes connected in series with said first and second windings respectively and said first and second diodes respectively, whereby the disconnection of all of said gas discharge units and said filaments from their fixture opens the output circuit from said inverter circuit.

* * * * *